US008469654B2

(12) United States Patent
Kurokawa et al.

(10) Patent No.: US 8,469,654 B2
(45) Date of Patent: Jun. 25, 2013

(54) FLUID MACHINE

(75) Inventors: Junichi Kurokawa, Kanagawa (JP); Shuusaku Kagawa, Kanagawa (JP)

(73) Assignee: National University Corporation Yokohama National University, Yokohama (JP)

( * ) Notice: Subject to any disclaimer, the term of this patent is extended or adjusted under 35 U.S.C. 154(b) by 515 days.

(21) Appl. No.: 12/735,600

(22) PCT Filed: Jan. 14, 2009

(86) PCT No.: PCT/JP2009/050391

§ 371 (c)(1),
(2), (4) Date: Jul. 30, 2010

(87) PCT Pub. No.: WO2009/096226

PCT Pub. Date: Aug. 6, 2009

(65) Prior Publication Data

US 2010/0322771 A1 Dec. 23, 2010

(30) Foreign Application Priority Data

Jan. 31, 2008 (JP) ..... 2008-020236

(51) Int. Cl.
*F04D 29/24* (2006.01)

(52) U.S. Cl.
USPC ..... 415/106; 415/98; 416/236 R

(58) Field of Classification Search
USPC ..... 415/77, 98, 106, 206, 902, 54.1, 415/55.1; 416/223 R, 235, 236 R
See application file for complete search history.

(56) References Cited

U.S. PATENT DOCUMENTS 4,883,403 A * 11/1989 Walker ..... 415/98
5,263,924 A 11/1993 Mathewson (Continued)

FOREIGN PATENT DOCUMENTS

JP 03-19489 2/1991
JP 2002-227795 8/2002

(Continued)

OTHER PUBLICATIONS

Yukio et al., Centrifugal Pump, Jul. 18, 2003, Abstract of JP 2003-201994.*

(Continued)

*Primary Examiner* — Edward Look
*Assistant Examiner* — Liam McDowell
(74) *Attorney, Agent, or Firm* — Staas & Halsey LLP

(57) ABSTRACT

A rotary-type fluid machine which enables practical and effective operation in an extremely low specific speed range. The rotary-type fluid machine (1, 1') has an impeller (10, 10') integrally connected to a rotating drive shaft (2). The impeller is accommodated in a casing (3). Fluid (a) of a suction fluid passage (4) to be pumped flows into a center part (11) of the impeller. The fluid (b) is discharged from a peripheral portion (12) of the impeller by the effect of the centrifugal force of the rotating impeller, so that the fluid is delivered through a delivery fluid passage (5) outside of the casing. Many grooves (15) extending toward a peripheral edge of the impeller from the center part of the impeller are formed on the impeller. The groove opens on an outer circumferential surface (18) of the impeller, and causes strong recirculation vortices (R) to be formed in the vicinity of the peripheral edge of the impeller when the impeller rotates.

20 Claims, 17 Drawing Sheets

U.S. PATENT DOCUMENTS

| | | | | |
|---|---|---|---|---|
| 5,290,236 | A | 3/1994 | Mathewson | |
| 5,591,404 | A | 1/1997 | Mathewson | |
| 6,533,537 | B1 * | 3/2003 | Nakada | 415/55.1 |
| 8,182,214 | B2 * | 5/2012 | Dickertmann et al. | 415/206 |
| 2003/0002982 | A1 | 1/2003 | Irie et al. | |
| 2005/0287022 | A1 | 12/2005 | Yaegashi et al. | |

FOREIGN PATENT DOCUMENTS

| | | | |
|---|---|---|---|
| JP | 2003-201994 | * | 7/2003 |
| JP | 2004-132209 | | 4/2004 |
| JP | 2004-353564 | | 12/2004 |
| JP | 2005-23794 | | 1/2005 |
| JP | 3884880 | | 11/2006 |
| WO | 88/02820 | | 4/1988 |
| WO | 94/02187 | | 2/1994 |

OTHER PUBLICATIONS

International Preliminary Report on Patentability for corresponding International Application PCT/JP2009/050391.

International Search Report for PCT/JP2009/050391; mailed Apr. 21, 2009.

* cited by examiner (A)

(B)

(A)

(B)

(A)

(B)

FLUID MACHINE

CROSS REFERENCE TO RELATED APPLICATIONS

This application claims the benefit under 35 U.S.C. Section 371, of PCT International Application No. PCT/JP2009/050391 filed Jan. 14, 2010, which claimed priority to Japanese Application No. 2008-020236, filed Jan. 31, 2010 in the Japanese Patent Office, the disclosures of which are hereby incorporated by reference.

TECHNICAL FIELD

The present invention relates to a rotary-type fluid machine, and more specifically, to the rotary-type fluid machine, such as a centrifugal pump, for feeding a fluid under pressure by rotation of an impeller.

BACKGROUND ART

As fluid machines for feeding fluids under pressure, rotary-type (turbo-type) pumps such as axial flow pumps, mixed flow pumps or centrifugal pumps, and reciprocating-type (displacement-type) pumps such as plunger pumps are known in the art. The former type (turbo-type) of pump generally has pump characteristics for operating suitably in a low fluid-head/high flow-rate operating range in which the specific speed is high. On the other hand, the latter type (displacement-type) of pump has the pump characteristics for operating suitably in a high fluid-head/low flow-rate operating range in which the specific speed is extremely low. A vortex pump (cascade pump) is known as a type of pump which can operate in an intermediate operating range (the specific speed is about 30) between the operating range of the turbo-type pump and the operating range of the displacement-type pump.

In Japanese Patent Publication No. 3884880 and Japanese Laid-open Patent Publication Nos. 2003-13898 and 2004-132209 (Patent Documents 1 through 3), the present inventors have proposed turbomachines having a structure wherein numerous shallow grooves for restricting prerotation of recirculating flow are formed in the direction of the pressure gradient on the inner wall surface of a casing in order to prevent the instability characteristics, which is so-called "rising unstable head curve characteristics" or "rising head curve characteristics" and which is peculiar to the turbo-type pumps. This groove is known in this technical field as "J groove." In the turbomachines described in Patent Documents 1 through 3 above, the prerotation flow is restricted by an extremely simple structure, in which the grooves are merely formed on the wall surface of the casing for suppressing various abnormal phenomena of fluid flow.

The inventors have also confirmed a phenomenon in that short grooves or depressions locally formed in the outer circumferential region of the back surface of the impeller (rotor wheel) of a centrifugal pump cause the fluid, which is discharged outward from the impeller, to flow back into the grooves. Such short grooves in the outer circumferential region of the back surface can be used as effective means for eliminating the aforementioned instability characteristics.

A centrifugal pump having an impeller, in which a small number of grooves are formed in its peripheral region, is disclosed in Japanese Laid-open Patent Publication No. 2002-227795. FIG. 18(A) is a schematic cross-sectional view showing the structure of this centrifugal pump. Grooves 102 of an impeller 101 are formed in its peripheral region 104. The centrifugal pump has a suction port 105 at its radially center part. The grooves 102 extend radially inward from an outer circumferential edge 103 of the impeller 101, but they do not reach the suction port 105. A flow rate restricting part 106 is formed between the grooves 102 and the suction port 105. In the flow rate restricting part 106, a stationary wall surface 107 of the pump casing is in the close proximity of a circular surface 108 of the impeller. The impeller 101 rotates about an axis X-X, so that a fluid "a" to be fed under pressure is forcibly pumped.

A centrifugal pump also having an impeller with a small number of grooves formed thereon is disclosed in Japanese Laid-open Patent Publication No. 2004-353564. FIG. 18(B) is a schematic cross-sectional view showing the structure of this centrifugal pump. The centrifugal pump has a suction port 115 at its radially center part. A small number of grooves 112 extend from an area of the suction port 115 to an outer circumferential edge 113 of the impeller 111. Numerous spiral grooves 119 constituting a dynamic bearing are formed in a peripheral region 114 of the impeller 111. The depth h of each of the spiral grooves 119 is about 10 to 100 μm. A side wall surface 117 of the pump casing is in the close proximity of a circular surface 118 of the impeller. The dimension v of a gap formed between the side wall surface 117 and the circular surface 118 is also about 10 to 100 μm.

Patent Document 1: Japanese Patent Publication No. 3884880

Patent Document 2: Japanese Laid-open Patent Publication No. 2003-13898

Patent Document 3: Japanese Laid-open Patent Publication No. 2004-132209

Patent Document 4: Japanese Laid-open Patent Publication No. 2002-227795

Patent Document 5: Japanese Laid-open Patent Publication No. 2004-353564

DISCLOSURE OF THE INVENTION

Problems to be Solved by the Invention

In general, the efficiency of a centrifugal pump or the other turbo-type pumps decreases significantly as the specific speed is reduced, and therefore, it is very difficult to practically operate a turbo-type pump at an extremely low specific speed range of approximately 70 or lower. A displacement-type pump or a vortex pump is therefore usually used in such a low specific speed range. However, the drawbacks described below have been indicated in the displacement-type pump and the vortex pump.

- Since fluid leakage significantly affects the pump efficiency, the dimensions of the gap or the like between the impeller and the casing must be strictly set and managed, and therefore, a highly accurate machining of component parts is required.
- The narrow gap between the impeller and the casing is easily affected by dust, particulates, and the like.
- Vibration and noise are relatively severe.
- A large number of component parts are assembled, and relatively many component parts slide against each other.
- It is difficult to attain speeding-up of operation, and also, it is difficult to increase the flow rate and reduce the size.

Such problems are considered to be overcome by employment of a centrifugal pump or the other turbo-type pumps. However, as previously mentioned, the efficiency of the pump is severely reduced if a turbo-type pump is operated in an extremely low specific speed range. The turbo-type pump therefore cannot be practically and effectively operated in the extremely low specific speed range.

A centrifugal pump designed to operate efficiently in such an extremely low specific speed range is disclosed in Japanese Laid-open Patent Publication No. 2002-227795 as set forth above. However, as shown in FIG. 18(A), this pump has a construction in which the grooves 102 and the suction port 105 are separated from each other by the flow rate restricting part 106. Therefore, even when this pump is operated in the extremely low specific speed range, the efficiency of the pump decreases significantly as the flow rate of the pump is increased. In addition, when the flow rate restricting part 106 is provided, vibration and noise are prone to occur due to cavitation and the like, and the flow rate of the pump therefore cannot be increased as desired in the pump disclosed in Japanese Laid-open Patent Publication No. 2002-227795.

A vortex pump provided with a small number of grooves reaching the center of the impeller is disclosed in aforementioned Japanese Laid-open Patent Publication No. 2004-353564. However, in this pump, the spiral grooves 119 formed in the peripheral region 114 must form a dynamic bearing, and the dimension v between the side wall surface 117 and the circular surface 118 must therefore be limited to about 10 to 100 μm. Specifically, in the pump structure disclosed in Japanese Laid-open Patent Publication No. 2004-353564, the dimension v of the gap must be strictly set and managed, and extremely high precision or machining precision of the component parts is required.

An object of the present invention is to provide a rotary-type fluid machine whereby (1) the aforementioned drawbacks (such as the need to maintain extreme accuracy or machining precision of component parts, the need to form strict and narrow clearances, and increase in the number of component parts) common to a displacement-type or vortex-type fluid machine can be overcome; (2) the speed and flow rate of the fluid machine can be increased by increasing the rotational speed of a rotating drive shaft; and (3) practical and effective operation can be achieved in an extremely low specific speed range.

Means for Solving the Problems

For achieving the abovementioned objects, the present invention provides a rotary-type fluid machine having an impeller integrally connected to a rotating drive shaft; a casing for accommodating the impeller; and an intake port provided so as to face a radially center portion of the impeller; the fluid machine comprising:

many grooves extending radially outward from the radially center portion of the impeller, which are formed at angular intervals in a side surface of the impeller positioned on its side facing the intake port, the grooves extending toward an outer circumferential edge of the impeller from a region radially inward of the intake port and opening on an outer circumferential surface of the impeller;

wherein a gap between the side surface of the impeller and a side wall surface of the casing has a dimension (q) equal to or greater than 0.4 mm or an impeller diameter $(d_2)\times0.002$; and wherein each of the grooves has a depth (h) equal to or greater than 0.4 mm or the impeller diameter $(d_2)\times0.002$ and generates recirculation vortices near a peripheral edge of the impeller when the impeller rotates.

From another aspect of the invention, the present invention provides a rotary-type fluid machine having an impeller integrally connected to a rotating drive shaft; a casing for accommodating the impeller; and an intake port provided so as to face a radially center portion of the impeller; the fluid machine comprising:

many grooves for generating recirculation vortices near an outer edge of the impeller during rotation of the impeller, which are formed in both side surfaces of the impeller, wherein the grooves in each of the surfaces extend at angular intervals toward an outer circumferential edge of the impeller from a region radially inward of the intake port and open on an outer circumferential surface of the impeller.

Preferably, fluid communicating holes extend through the radially center portion of the impeller, so that the gaps on either side of the impeller are in communication with each other by the holes, wherein each of the gaps is formed between the side wall surface of the casing and the surface of the impeller.

From yet another aspect of the invention, the present invention provides a rotary-type fluid machine having an impeller integrally connected to a rotating drive shaft; a casing for accommodating the impeller; and an intake port provided so as to face a radially center portion of the impeller; the fluid machine comprising:

many grooves for generating recirculation vortices near an outer edge of the impeller during rotation of the impeller, which are formed in a side surface of the impeller positioned on its side facing the intake port, the grooves extending at angular intervals toward an outer circumferential edge of the impeller from a region radially inward of the intake port and opening on an outer circumferential surface of the impeller;

wherein the casing is a circular casing, which has a front side wall surface, a rear side wall surface and an annular inner circumferential wall surface, and which defines a circular casing inside region centering around a rotational axis of the impeller; and wherein the recirculation vortices (R) are formed by radially outward flows (F) generated inside the grooves, radially inward flows (E) generated near the side wall surface of the casing, and recirculation flows (G) splitting from the radially inward flows (E) and recirculating into the grooves.

According to the arrangement of the present invention, as the impeller is rotated by the rotation of the rotating drive shaft, the intense flows (F) directed to the peripheral portion of the impeller occur inside and near the grooves. At the same time, the intense flows (E) directed radially inward are generated near the stationary wall surface (the side wall surface) of the casing which is opposed against the side surface of the impeller. As a result, the intense recirculation vortices (R) are generated near the outer edge of the impeller. The fluid speed in the fluid passage inside the casing is increased by formation of the recirculation vortices, whereby the fluid head of the fluid machine is significantly raised. Consequently, a rotary-type fluid machine having this arrangement can operate effectively and practically in the extremely low specific speed range.

Further, the fluid machine configured as described above has a structure so arranged that fluid is urged radially outward by the centrifugal force of the rotating impeller, and therefore, the speed and flow rate of the fluid machine can be increased by increasing the rotational speed of the rotating drive shaft. It is thus possible to achieve a reduction in the size of the fluid machine, which cannot be achieved by a displacement-type pump, a vortex pump, or the like, because of its mechanical structure.

Furthermore, the fluid machine configured as described above is a rotary-type fluid machine having a simple structure, and the clearance between the impeller and the stationary wall surfaces (side wall surfaces) of the casing can be set to a relatively large size. Therefore, according to the present invention, it is unnecessary to strictly limit the clearance to such a small dimension as in a displacement-type pump, a vortex pump, or the like. Thus, the aforementioned drawbacks (such as the need to maintain extreme accuracy or machining precision of component parts, the need to form strict and narrow clearances, and increase in the number of component parts) common to the displacement-type and vortex-type fluid machines can be overcome.

The fluid machine of the present invention does not utilize the aforementioned flow rate restricting part (Japanese Laid-open Patent Publication No. 2002-227795), and therefore does not have the drawbacks of severely reduced efficiency, which is caused when the flow rate increases, nor vibration and noise owing to cavitation or the like. Consequently, the fluid machine of the present invention allows the flow rate to be increased by increasing the rotational speed of the rotating drive shaft, as set forth above.

In addition, since the fluid machine of the present invention does not utilize the aforementioned dynamic bearing with use of grooves in the peripheral portion of the impeller (Japanese Laid-open Patent Publication No. 2004-353564), the gap for generating the radially inward flows (E) and the recirculation flows (G) is formed between the side surface of the impeller and the side wall surfaces of the casing. The recirculation vortices (R) are therefore generated near the outer edge of the impeller when the impeller rotates in the fluid machine of the present invention. The recirculation vortices significantly increase the fluid head of the fluid machine, as described above.

In the present specification, "many" grooves means at least ten grooves, and the "center part" or "center portion" of the impeller is a central region of the impeller having a diameter equal to or less than ½ of the impeller diameter, and is the portion of the impeller which includes parts (boss, fitting, key connector, or the like) connected to the rotating drive shaft.

Effect of the Invention

The following effects or advantages can be obtained by the fluid machine of the present invention:

(1) The drawbacks (such as the need to maintain extreme accuracy or machining precision of component parts, the need to form strict and narrow clearances, and increase in the number of component parts) common to a displacement-type or vortex-type fluid machine can be overcome;

(2) The speed and flow rate of the fluid machine can be increased by increasing the rotational speed of a rotating drive shaft; and (3) Practical and effective operation can be achieved in an extremely low specific speed range.

BRIEF DESCRIPTION OF THE DRAWINGS

FIGS. 10(A) and 10 (B) depict, respectively, a cross-sectional view and a graph showing a relationship between the pump performance and a clearance, the clearance being held between each of side surfaces of the impeller and each of stationary wall surfaces of the casing;

FIGS. 15(A), 15(B) and 15 (C) depict schematic front views showing modifications of the grooves on the impeller;

EXPLANATION OF REFERENCE NUMERALS

Figure 1:
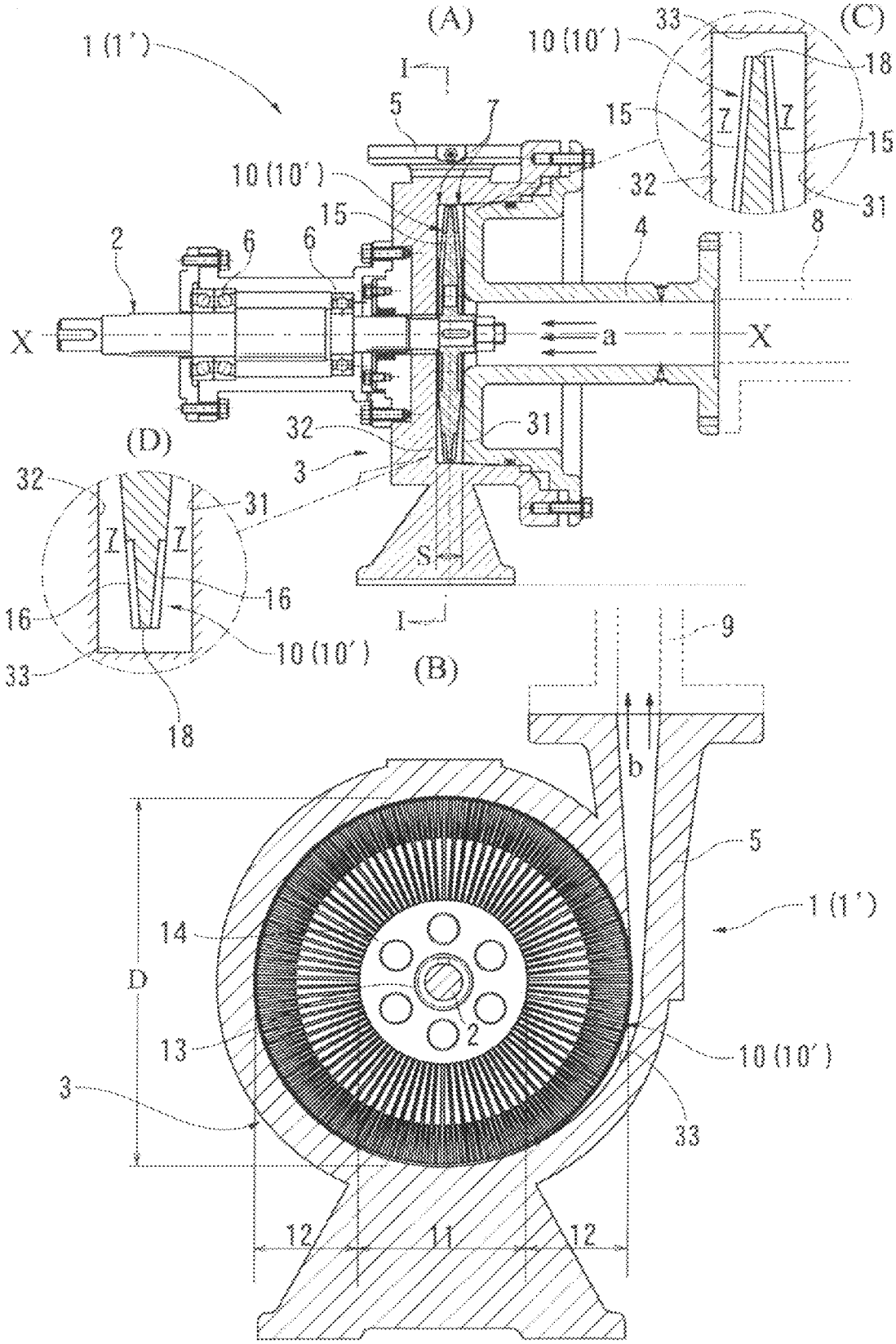
FIGS. 1(A), 1(B), 1(C) and 1(D) depict, respectively, a longitudinal cross-sectional view, a cross-sectional view along line I-I, and partially enlarged cross-sectional views showing an embodiment of a centrifugal pump to which the present invention is applied.

1, 1': centrifugal pump (fluid machine)
2: rotating drive shaft
3: casing
4: inflow conduit
5: discharge conduit
6: bearing
7: liquid passage in casing (meridian fluid passage section)
8: liquid feeding conduit
9: liquid delivery conduit
10, 10': impeller (rotor wheel)
11: center portion
12: annular outside portion
13: boss portion
14: balance hole (through-hole)
15: radial groove
16: outer edge groove (short groove)
17: land portion
18: outer circumferential surface
X-X: rotational axis

BEST MODE FOR CARRYING OUT THE INVENTION

In a preferred embodiment of the present invention, the fluid machine of the present invention is a centrifugal pump which operates in an extremely low specific speed range which is 70 or lower. Preferably, the grooves are arranged uniformly at a uniform angular interval in the entire side wall surface of the impeller, and the angular interval (k) of the grooves is set to be 10 degrees or less.

Numerous grooves extending in a radial direction from the center portion of the impeller gather at the center portion of the impeller. When the number of grooves is increased, the boundaries of the adjacent grooves are lost, so that the adjacent grooves are integrated, whereby the numerous grooves are circularly or annularly connected continuously at the center portion of the impeller. Specifically, when the number of grooves is increased, the grooves form a circular or annular depression or concave part at the center portion of the impeller. Preferably, a diameter ($d_1$) of the depression or concave part is larger than a diameter ($d_0$) of the intake port, and the intake port is entirely encompassed by the external outline of the depression or concave part.

According to a preferred embodiment of the present invention, the grooves are straight grooves which extend linearly outward from the center portion of the impeller, or curved or helical grooves which extend from the center portion of the impeller while curving radially outward in curved or helical fashion. The concept of linear grooves includes radial grooves which extend outward in the radial direction from the rotational center, as well as straight grooves which extend in a direction tilted at a predetermined angle with respect to the radial direction. The tilting direction of the grooves, or the direction of the curved or radial grooves is not necessarily limited to be rearward of the rotational direction of the impeller, but may be forward of the rotational direction.

The dimension (q) of the gap is preferably set to be equal to or greater than 1.0 mm or the impeller diameter ($d_2$)×0.005, and more preferably, equal to or greater than 3.0 mm or the impeller diameter ($d_2$)×0.015. The depth (h) of the grooves is preferably set to be equal to or less than 6.0 mm or the impeller diameter ($d_2$)×0.03. The width (w) of the grooves is preferably set to be equal to or less than 40 mm or the impeller diameter ($d_2$)×0.2 (more preferably, equal to or less than 20 mm or the impeller diameter ($d_2$)×0.10).

If desired, short grooves or recesses (hereinafter referred to as short grooves), which extend radially outward to open on the outer circumferential surface, may be further formed on the land portions between the adjacent grooves. The short grooves are disposed on an outer periphery, and outer ends of the short grooves open on the outer circumferential surface of the impeller in the same manner as the aforementioned grooves.

In a preferred embodiment of the present invention, the grooves are formed on the surfaces of both sides of the impeller, and the impeller has communicating means for causing fluid passages, which are formed on both sides of the impeller in a casing, to be in communication with each other. The communicating means is preferably composed of through-holes which extend through the center portion of the impeller in a direction of its rotational axis. For example, a plurality of circular through-holes is formed at an equal angular interval in the radially center portion of the impeller.

In a preferred embodiment of the present invention, a thickness (T) of the center portion of the impeller is set to be a dimension larger than a thickness (T') of the outer periphery of the impeller, and the thickness of the impeller gradually decreases toward the outside in the radial direction.

Embodiment

Preferred embodiments of the present invention are described in detail with reference to the accompanying drawings hereinafter.

FIG. 1 includes a longitudinal cross-sectional view, a cross-sectional view along line I-I, and a partially enlarged cross-sectional view showing an embodiment of a centrifugal pump to which the present invention is applied.

A centrifugal pump 1 constituting a rotary-type fluid machine is shown in FIG. 1. The pump 1 has a rotating drive shaft 2 provided concentrically with a rotational axis X-X; a circular casing 3; an inflow conduit (suction conduit) 4; and an impeller (rotor wheel) 10. The impeller 10 is accommodated concentrically within the casing 3 and integrally connected to the rotating drive shaft 2, which constitutes the primary shaft of the pump 1. The rotating drive shaft 2 extends through bearings 6 and rotatably carried by the bearings 6. The rotating drive shaft 2 is connected to a primary drive such as an electric motor (not shown). A front side wall surface 31, a rear side wall surface 32 and an annular inner circumferential wall surface 33 of the casing 3 define a circular (round cylindrical or round columnar) internal region therein (diameter D and thickness S), which has the rotational axis X-X at the center thereof. Fluid passages 7 are formed on both sides (front and rear sides) of the impeller 10 provided in the internal region.

The inflow conduit 4 is connected to the casing 3 concentrically with the rotational axis X-X. A liquid feeding conduit 8 (shown by imaginary lines) is connected to the inflow conduit 4. The liquid feeding conduit 8 is in communication with a liquid feeding source (not shown). A discharge conduit 5 is connected tangentially to the casing 3. A liquid delivery conduit 9 (indicated by imaginary lines) is connected to the discharge conduit 5. The liquid delivery conduit 9 is in communication with an arbitrary device or conduit system (not shown).

The centrifugal pump 1 draws the liquid (water or other liquid) of the liquid feeding source into the casing 3 by the effect of the centrifugal force of the rotating impeller 10. As indicated by the arrow "a" in FIG. 1(A), the liquid of the liquid feeding source flows into the fluid passages 7 via the conduits 4, 8 under the suction pressure of the centrifugal pump 1. The liquid in the fluid passages 7 is discharged outward from the outer peripheral portion of the impeller by the centrifugal force of the rotating impeller 10, the liquid flows out to the discharge conduit 5 as indicated by the arrow "b" in FIG. 1(B), and the liquid is delivered to the connected device or conduit system.

Figure 2:
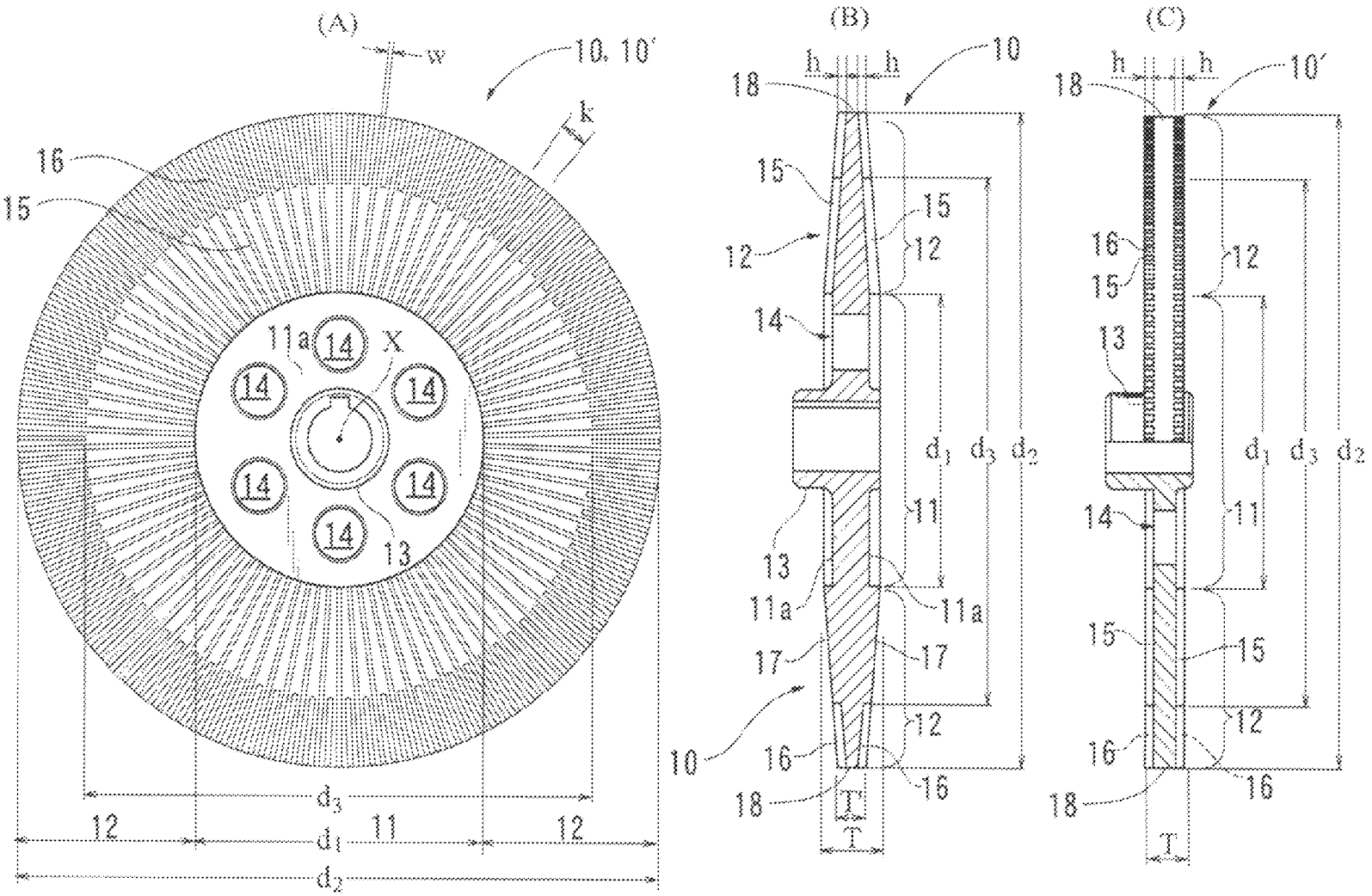
FIGS. 2(A), 2(B) and 2(C) depict, respectively, a front view and cross-sectional views showing two types of impeller structures.
Figure 3:
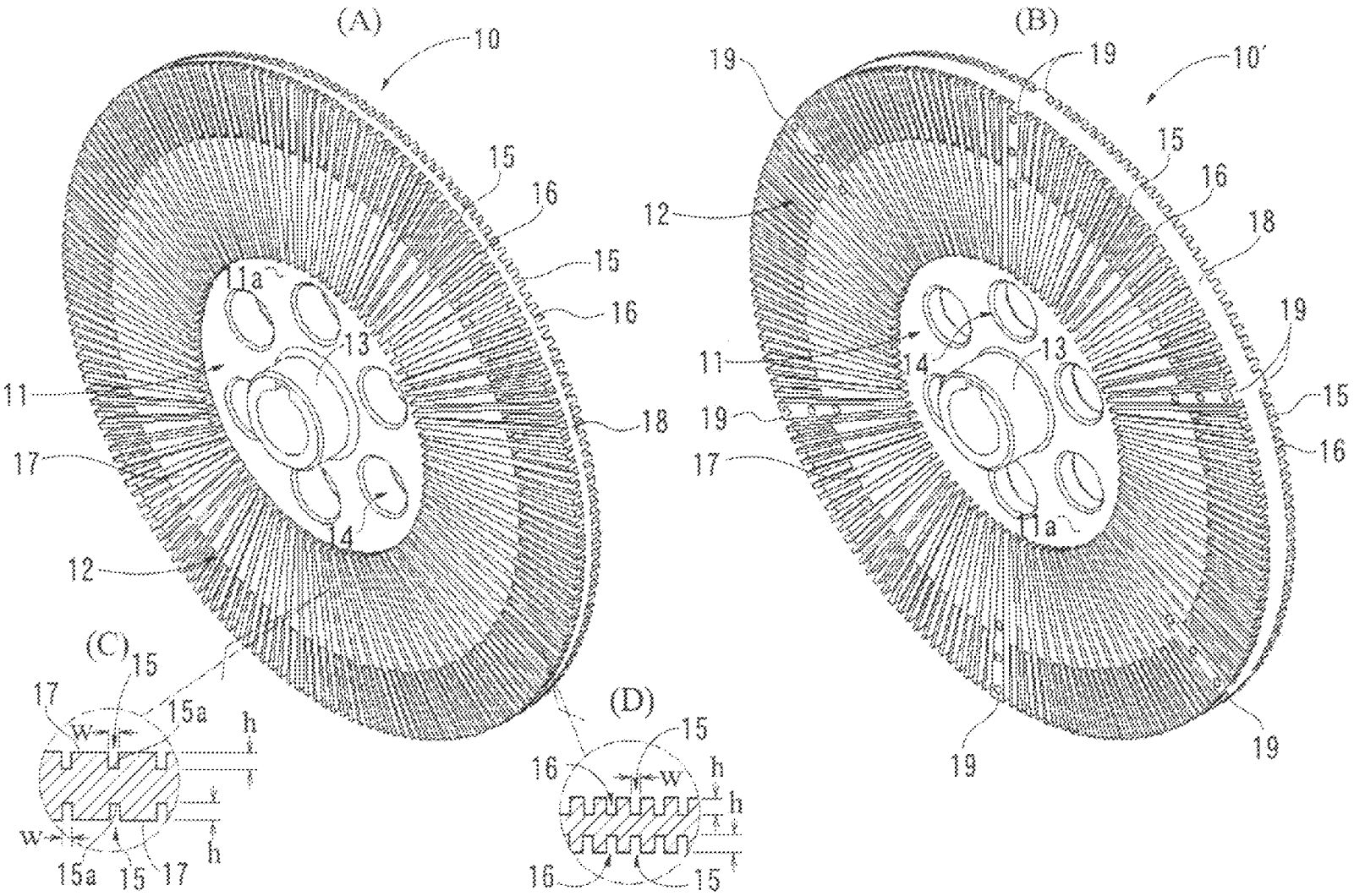
FIGS. 3(A), 3(B), 3(C) AND 3(D) depict, respectively, perspective views and partially enlarged cross-sectional views showing the impeller shown in FIG. 2(A)
Figure 4:
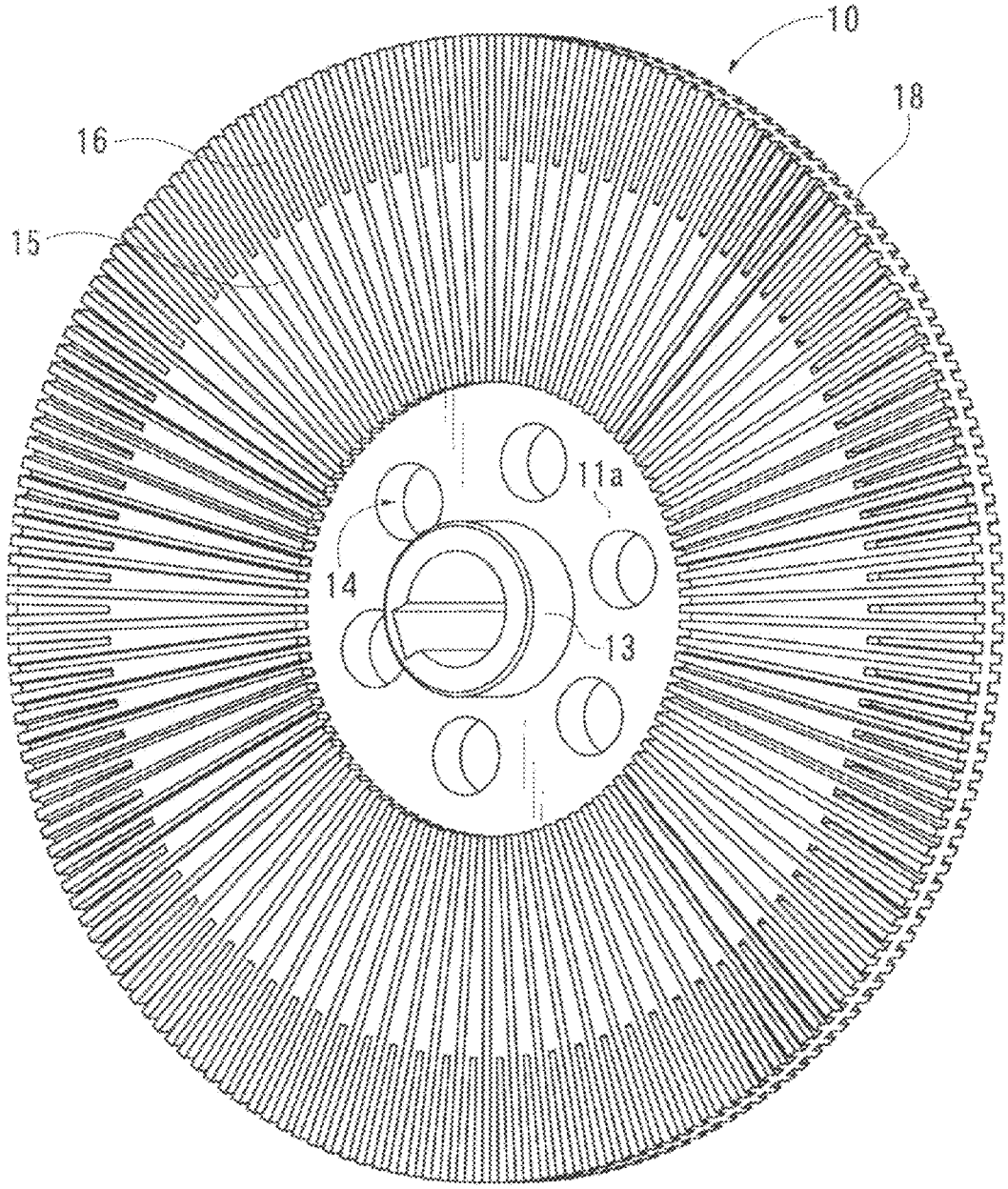
FIG. 4 is a perspective view showing an appearance of a front side of the impeller shown in FIG. 3(A)
Figure 5:
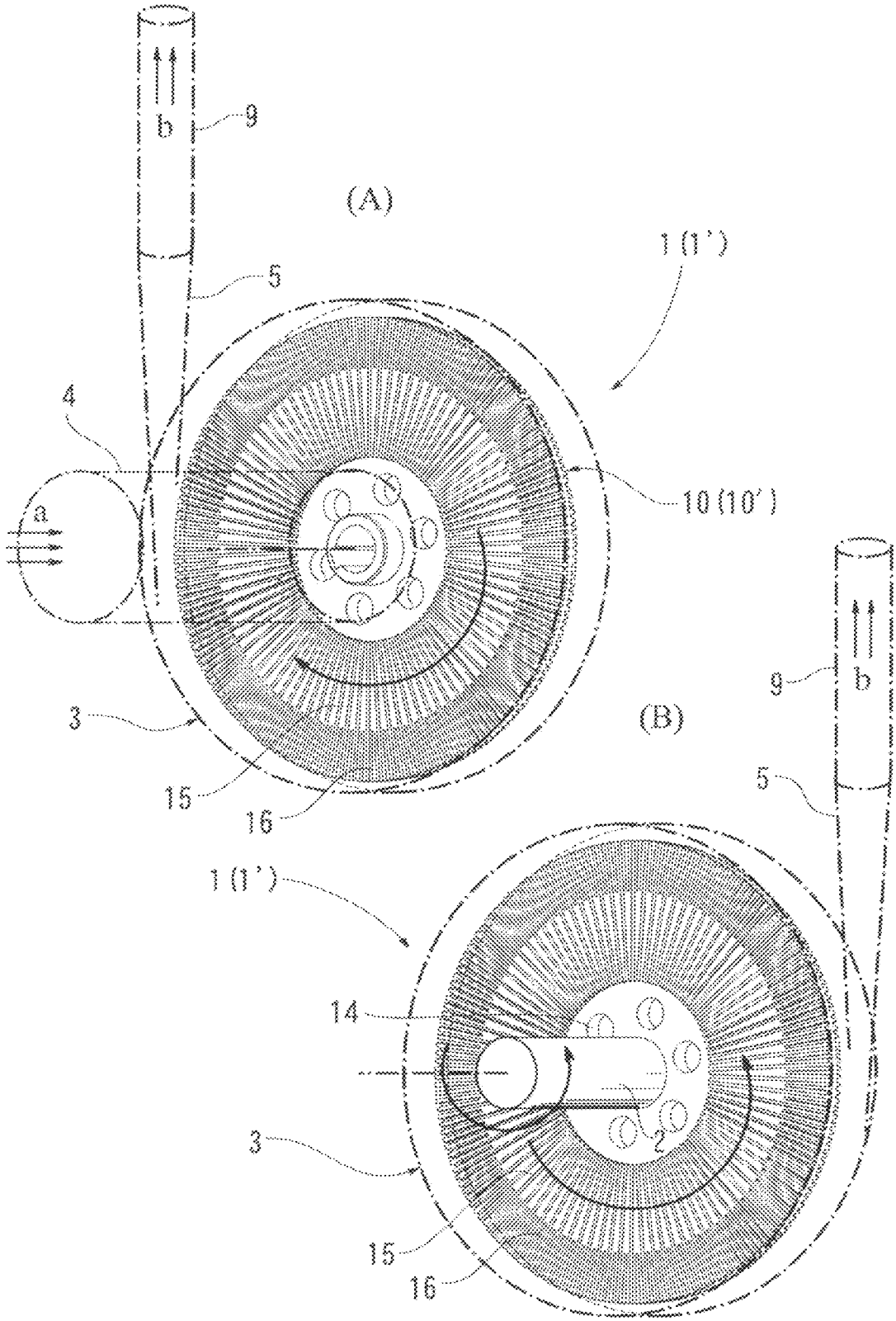
FIGS. 5(A) and 5(B) depict, respectively, front and rear perspective views conceptually showing an overall structure of a pump mechanism provided with the impeller shown in FIG. 2(A)

FIGS. 2, 3, and 4 include a front view, cross-sectional views and perspective views, showing the structure of the impeller, and FIG. 5 includes conceptual perspective views showing the structure of the pump mechanism provided with the impeller.

FIGS. 2(A), 2(B), and 3(A) are a front view, a cross-sectional view and a perspective view of the impeller 10 shown in FIG. 1. FIGS. 2(C) and 3(B) show the structure of an impeller 10' which is a modification of the impeller 10.

The impeller 10 is composed of a center portion 11 (range of diameter $d_1$) having a boss portion 13 and balance holes 14; and an annular outside portion 12 (range of diameter $d_2$-$d_1$) which does not include the center portion 11. A large number of radial grooves 15 and a large number of outer edge short grooves 16 are formed in the annular outside portion 12. The radial grooves 15 are arranged at a uniform angular interval k. The outer ends of the radial grooves 15 and the short grooves 16 open in an outer circumferential surface 18 of the impeller 10. FIGS. 3(C) and 3(D) are cross-sectional views showing the radial grooves 15. The grooves 15 are recesses or depressions, which extend continuously in the radial direction of the impeller 10 and which form radial channel flow passages on the surface of the impeller 10. As shown in FIG. 3(C), land portions 17 are formed between the grooves 15. At the outer edge of the impeller 10, the width of the land portions 17 is greater than the width w of the grooves 15, and the short grooves 16 are formed on the land portions 17 in a peripheral zone of the impeller 10 (FIG. 3(D)).

The boss portion 13 is fitted on the rotating drive shaft 2 and integrally connected to the shaft 2. The balance holes 14 constituting the communicating means are formed in the center portion 11 at circumferentially equal intervals (angular intervals of 60 degrees in the present embodiment), each extending through the center portion 11. The regions on both sides of the impeller 10 (the liquid passages 7), in which the liquid flows, are in fluid communication with each other via the balance holes 14.

Since the numerous radial grooves 15 converge in the center region of the impeller 10, the boundaries between adjacent radial grooves 15 are lost therein, and the adjacent radial grooves 15 integrate with each other. As a result, the numerous radial grooves 15 form a continuous ring in the center region of the impeller, and a circular or annular side surface 11*a*, which retreats overall into the surface of the impeller 10, is formed in the center portion 11 of the impeller 10 so as to be continuous with bottoms 15*a* of the radial grooves 15. That is, the circular or annular depression or concave portion formed in the center portion 11 of the impeller 10 is the convergence of the radial grooves 15. The independent portions of the radial grooves 15 (the portions of the grooves 15 outside of the side surface 11*a*) preferably have a length equal to or greater than ½ of the radius of the impeller.

In this embodiment, the radial grooves 15 and the short grooves 16 have the same width (w) and depth (h), and are arranged in alternate fashion in the circumferential direction, in the peripheral zone of the impeller 10. The dimensions of each part of the impeller 10 are set as described below, for example.

Diameter $d_1$ of the center portion 11=90 mm
Diameter (outer diameter) $d_2$ of the impeller 10=202 mm
Diameter $d_3$ of the region in which only the radial grooves 15 are formed=160 mm
Groove width w=2 mm
Groove depth h=3 mm
Number of radial grooves 15=90 (each side)
Number of outer edge short grooves 16=90 (each side)
Angular interval k=4°

As shown in FIG. 2(B), the impeller 10 has a uniform thickness T in the center portion 11 of the impeller 10. The thickness of the annular outside portion 12 gradually decreases toward the outside in the radial direction, and the outer circumferential edge of the annular outside portion 12 has a minimum dimension T'. By thus increasing the thickness of the center portion 11, the structural strength and rigidity of the impeller 10 can be relatively easily ensured, and the weight thereof can also be reduced.

FIGS. 2(C) and 3(B) show the impeller 10' which is a modification of the impeller 10. In FIGS. 2(C) and 3(B), constituents or elements, which are substantially the same as the constituents or elements of the impeller 10, are indicated by the same reference numerals. FIG. 2(C) is a partially cutaway cross-sectional view showing the impeller 10', in which only one side thereof is cut away.

Figure 16:
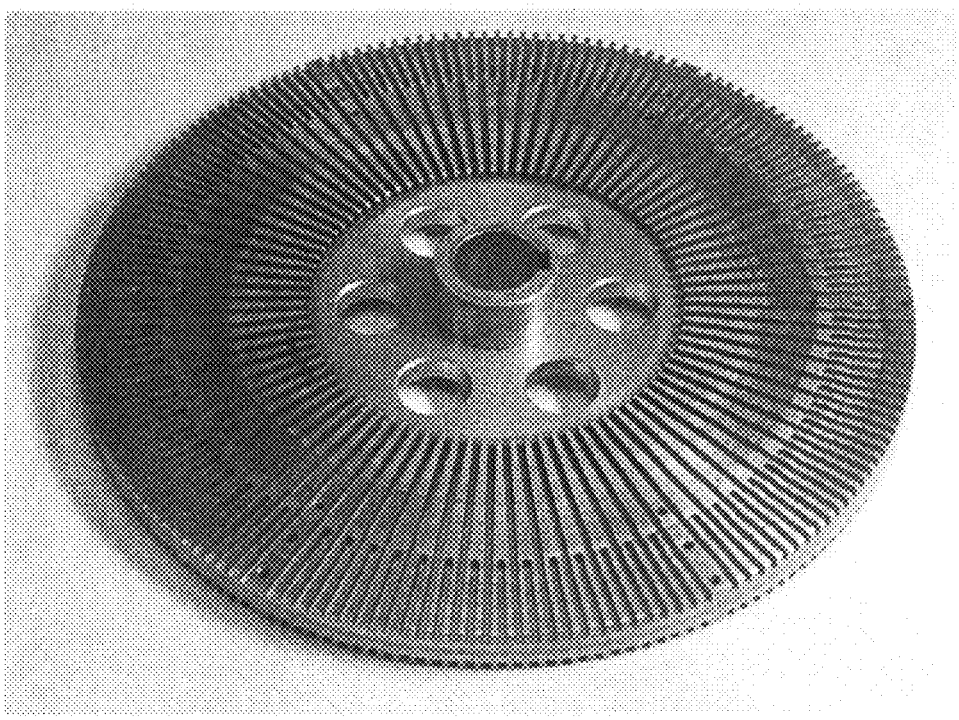
FIG. 16 is a perspective view (photograph) showing the appearance of the front side of the impeller shown in FIG. 3(B)
Figure 17:
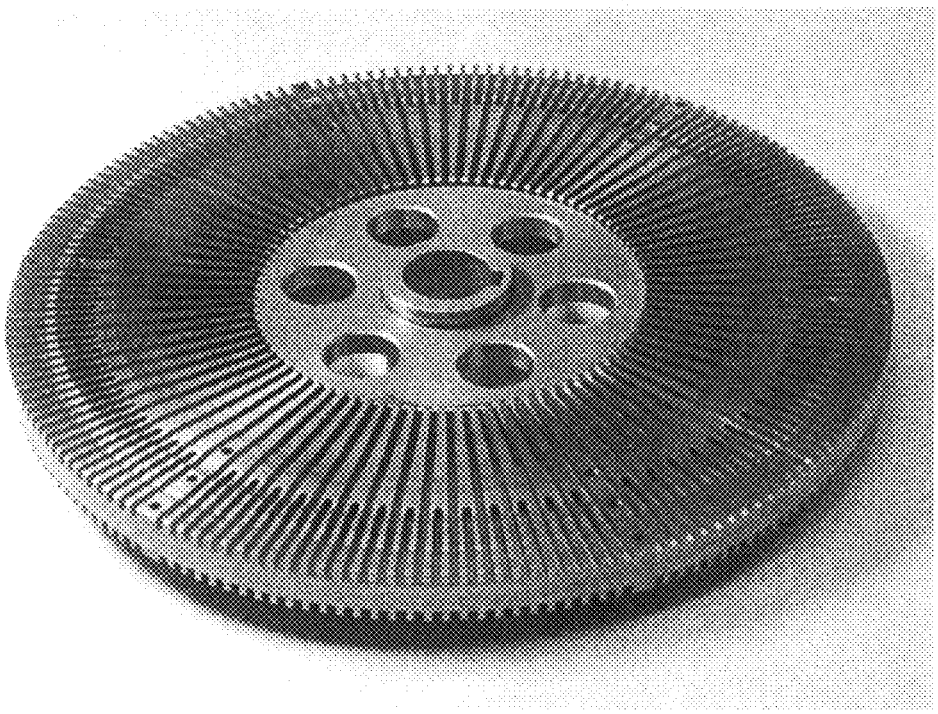
FIG. 17 is a perspective view (photograph) showing the appearance of a rear side of the impeller shown in FIG. 3(B)
Figure 18:
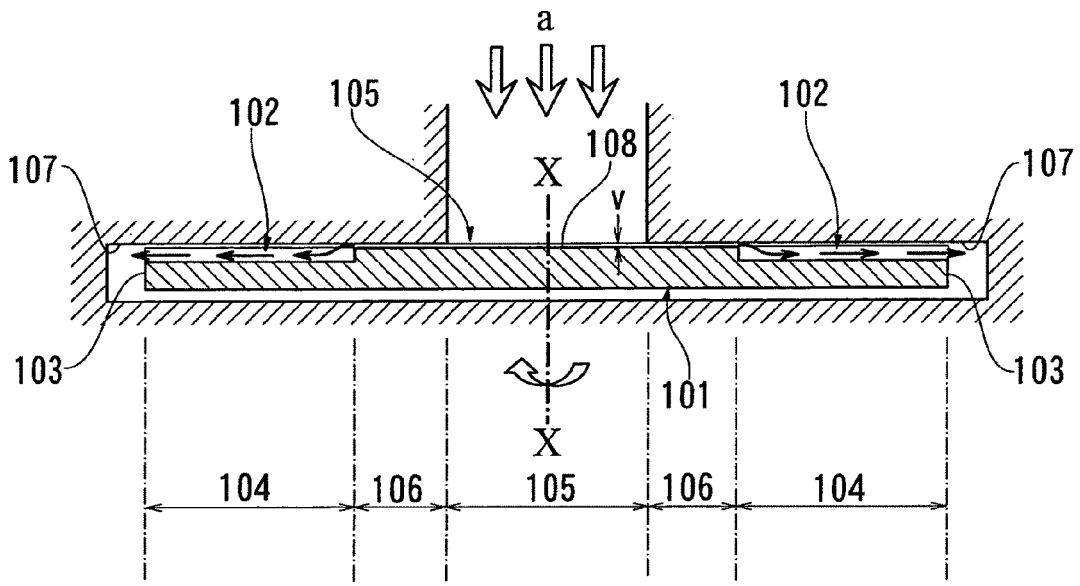
FIGS. 18(A) and 18(B) depict schematic cross-sectional views showing a structure of a centrifugal pump or vortex pump, each having an impeller of a conventional structure.
Figure 18:
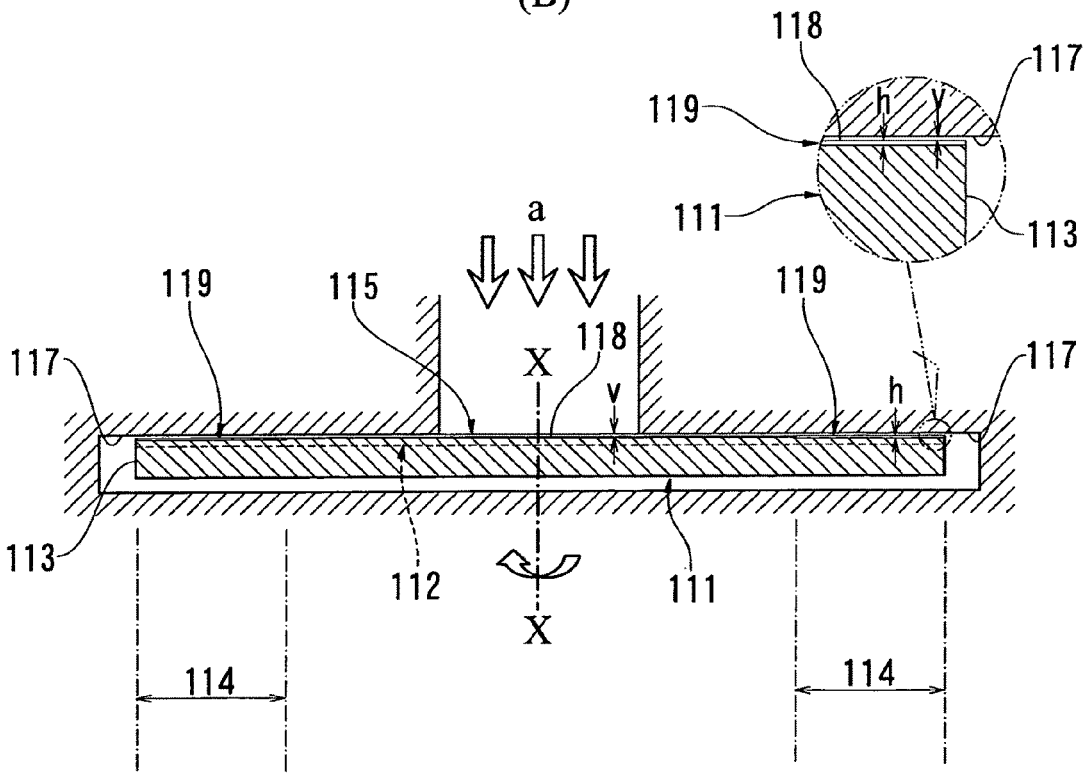

The annular outside portion 12 of the impeller 10' shown in FIGS. 2(C) and 3(B) has an overall uniform thickness T. The impeller 10' has radial land portions 19 to which an annular side panel (not shown) can be attached. Fixing an annular side panel to the radial land portions 19 enables the impeller 10' to be further modified into a closed-type impeller. The other structures of the impeller 10' are substantially the same as those of the previously described impeller 10. FIGS. 16 and 17 are perspective views (photographs) showing the appearance of the impeller 10' shown in FIGS. 2(C) and 3(B).

Figure 6:
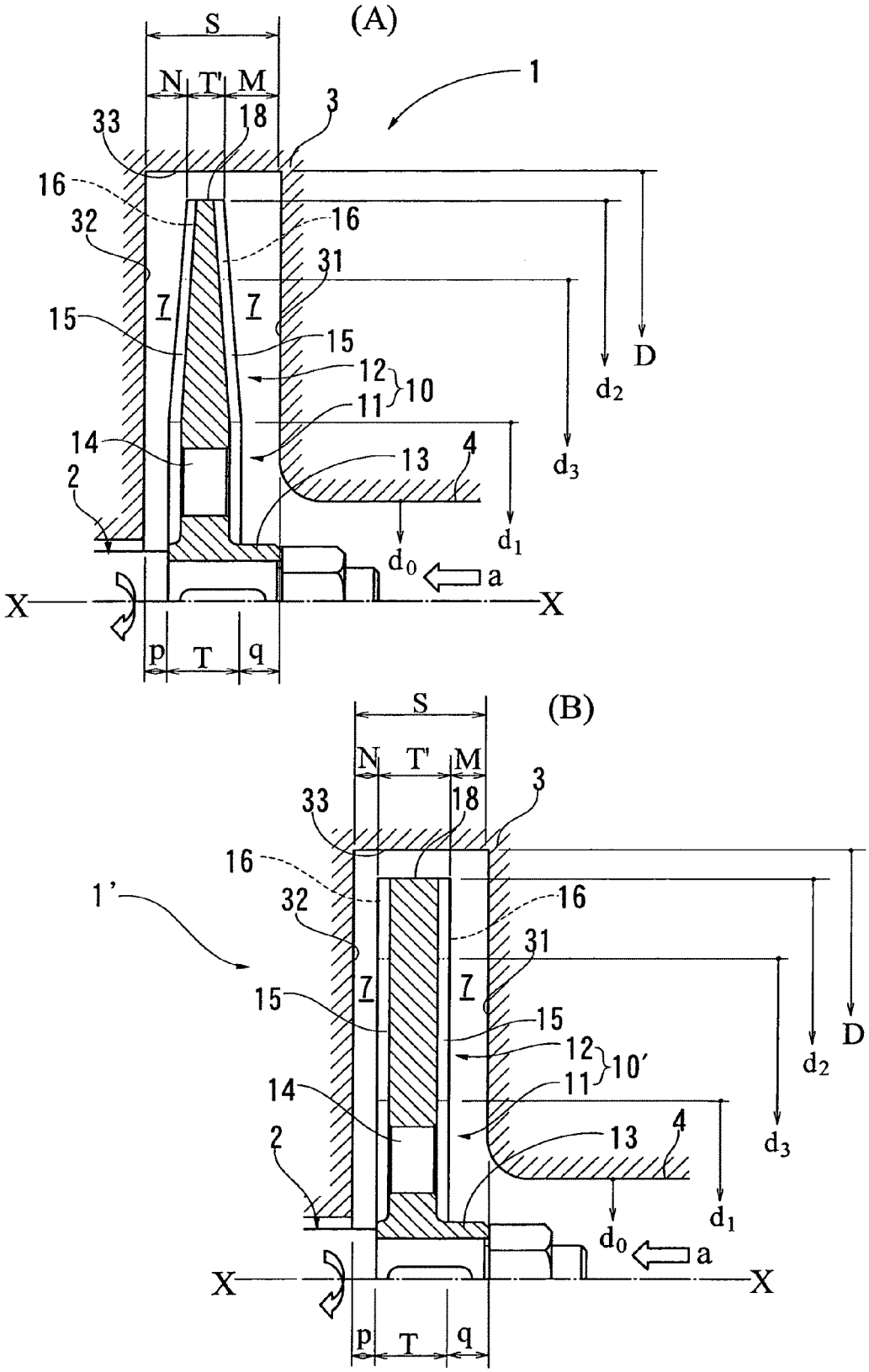
FIGS. 6(A) and 6(B) depict, respectively, partially enlarged cross-sectional views showing positional relationships between a casing and two types of impellers in the centrifugal pump.

FIG. 6 includes partially enlarged cross-sectional views showing the centrifugal pumps 1, 1', wherein the positional relationships between the impellers 10, 10' and the casing 3 are illustrated. In the pump 1 (FIG. 6(A)) provided with the impeller 10, the cross-section of a meridian fluid passage section (the fluid passage 7) formed between the impeller 10 and the inner wall surface 31, 32 of the casing 3 has a configuration which spreads to the outside in the radial direction, owing to the dimensional difference between the thickness T of the center portion 11 and the thickness T' of the outer circumferential surface 18. The sectional dimension (width N, M) of the median fluid passage section (the fluid passage 7) increases at the outer edge portion of the impeller 10. On the other hand, in the pump 1' (FIG. 6(B)) provided with the impeller 10', the cross-section of the median fluid passage section (the fluid passage 7) having a uniform dimension (width N, M) is formed between the impeller 10' and the inner wall surface 31, 32 of the casing 3.

The dimensions p, q of the gaps between the side surfaces of the impellers 10, 10' and the inner wall surfaces 31, 32 are set to be equal to or greater than 0.4 mm and the impeller diameter $(d_2)\times0.002$, preferably, equal to or greater than 1.0 mm and the impeller diameter $(d_2)\times0.005$, and more preferably, equal to or greater than 3.0 mm or the impeller diameter $(d_2)\times0.015$. The depth (h) of the grooves is set to be equal to or greater than 0.4 mm and the impeller diameter $(d_2)\times0.002$. Preferably, the depth (h) of the grooves is set to be equal to or greater than 1.0 mm and the impeller diameter $(d_2)\times0.005$, and equal to or less than 6.0 mm and the impeller diameter $(d_2)\times0.03$. The width (w) of the grooves is set to be equal to or less than 40 mm and the impeller diameter $(d_2)\times0.2$, and preferably, equal to or less than 20 mm and the impeller diameter $(d_2)\times0.10$.

The inner wall surfaces (stationary wall surfaces) 31, 32 of the front and rear of the casing 3 are spaced apart from the front and rear side surfaces of the impellers 10, 10', and the clearances between the casing 3 and the impellers 10, 10' are considerably large dimensional values p, q, which are quite different from the small clearance permitted between a casing and a piston (or between a casing and an impeller) in a displacement-type pump, a vortex pump, or the like.

Figure 7:
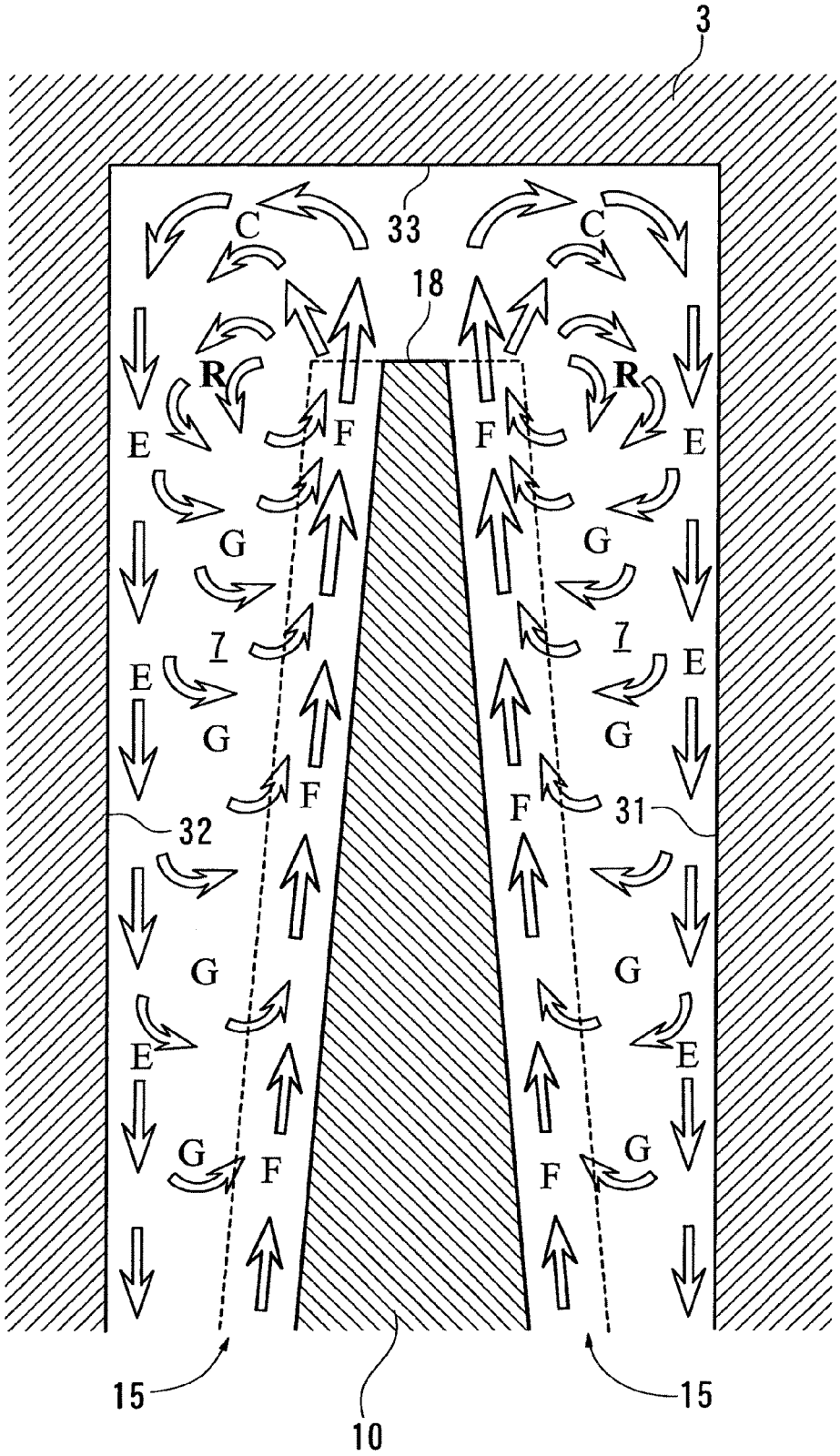
FIG. 7 is a conceptual cross-sectional view showing fluid flows generated in and near radial grooves.

FIG. 7 is a conceptual cross-sectional view showing the liquid flows formed in the pump 1 with the impeller 10, in which the liquid flows formed in and near the radial grooves 15 are indicated by arrows.

When the impeller 10 rotates, the centrifugal force of the rotating impeller 10 generates intense radial outward flows F in and near the radial grooves 15. The flows F turn radially inward between the outer circumferential edge of the impeller 10 and the annular inner circumferential wall surface 33 of the casing 3 (turning flows C), and the liquid flows backward in the vicinity of the stationary wall surfaces 31, 32 as radially inward flows E. Thus, the intense flows E directed radially inward are therefore formed near the stationary wall surfaces 31, 32. Between the opposing flows E, F, recirculation flows G recirculating into the grooves 15 are formed which split from the radially inward flows E. Intense recirculation vortices R are generated in the vicinity of the outer edge portion of the impeller 10 by the action of such flows C, E, F, G The recirculation vortices R increase the pressure of the annular fluid passage (circumferential fluid passage) outside of the impeller 10, substantially uniformly along the entire circumference. Such recirculation vortices R are of a novel character and are not generated in the conventional pumps, and these vortices significantly increase the pump head of the fluid machine.

Figure 8:
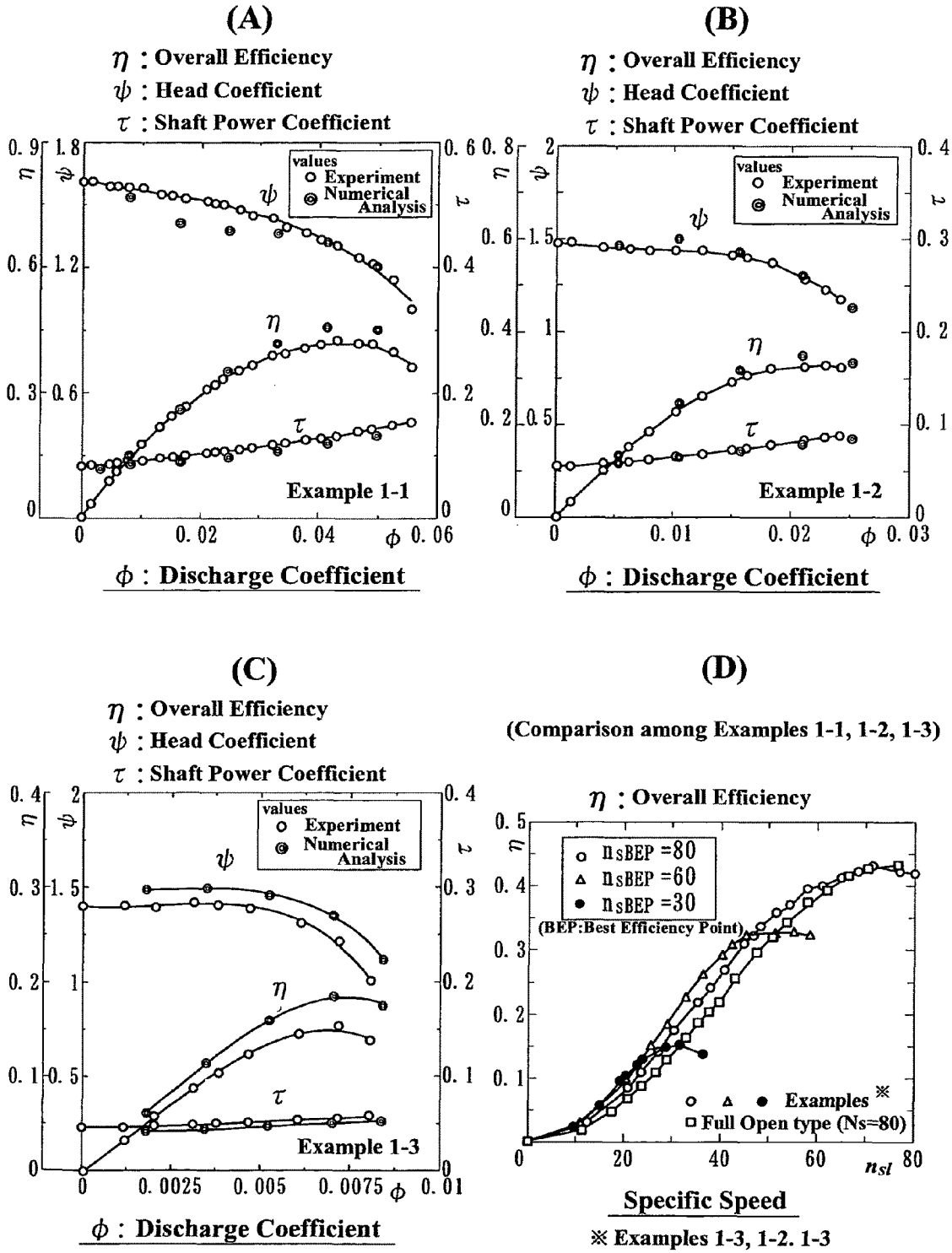
FIGS. 8(A), 8(B), 8(C) and 8(D) depict graphs showing a pump performance of the centrifugal pump provided with a grooved impeller.

The present inventors conducted various experiments and performed CFD (Computational Fluid Dynamics) analysis and other numerical analyses in order to evaluate the performance of centrifugal pumps 1, 1' provided with the impellers 10, 10' configured as described above. FIG. 8 includes graphs showing the pump performance of the centrifugal pump 1 (Example 1). FIGS. 8(A) through 8(C) show the experimental results (experimental values) and results of numerical analysis with respect to pump performance of pumps with three different types of casings (specific speed $n_{S\ BEP}$ at maximum efficiency=80, 60, 30). In a centrifugal pump or the like provided with a conventionally structured impeller, the unstable head curve characteristics were occurred in the pump head curve over the almost entire range with respect to a specific speed of 60 or lower, whereby vibration and noise tended to increase. In addition, the head coefficient ψ was merely about 1.1 to 1.2. However, in the centrifugal pump 1 provided with the impeller 10, remarkably high pump head was obtained, as shown in FIGS. 8(A) through 8(C). Further, unstable head curve characteristics in the pump head curve of the centrifugal pump 1 were not caused, and stable and quiet operation was realized. Regarding the pump efficiency, FIG. 8(D) shows the results of comparing the centrifugal pump 1 with a conventionally structured pump having a full-open impeller which has relatively stable characteristics. As shown in FIG. 8(D), the centrifugal pump 1 ($n_S$=80) effected high efficiency throughout the entire specific speed range in comparison with the conventionally structured pump having an $n_S$=80 casing. At even lower specific speed ranges, the centrifugal pump 1 effected even higher efficiency, when the specific speed of the casing of the centrifugal pump 1 was reduced.

Figure 9:
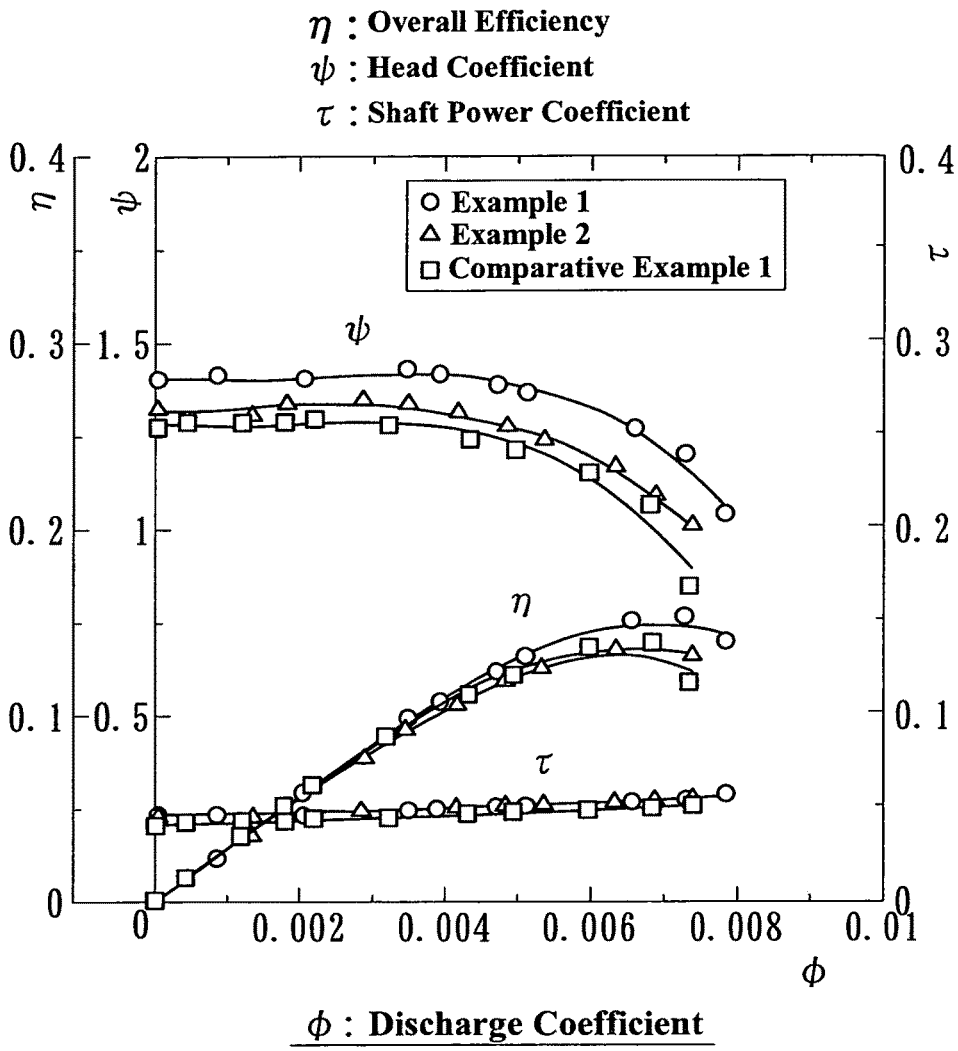
FIG. 9 is a graph showing the pump performance of the centrifugal pump provided with a grooved impeller.

FIG. 9 is a graph showing the performance of each of the centrifugal pump 1 (Example 1) provided with the impeller 10, the centrifugal pump 1' (Example 2) provided with the impeller 10', and a centrifugal pump (Comparative Example 1) provided with a closed impeller. The impeller of Comparative Example 1 had a modified design in which a circular side panel (not shown) was attached to the land portions 19 of the impeller 10' to form a closed impeller. The centrifugal pumps of Examples 1 and 2 and Comparative Example 1 were each provided with the same circular casing.

In comparison with the centrifugal pump 1' (Example 2), the pump head was reduced in the centrifugal pump of Comparative Example 1 in which the impeller was modified to a closed design with the radial grooves 15 concealed by a side panel. Therefore, the three-dimensional counter currents C, E, G and the recirculation vortices R, which are created in the median fluid passage section (the fluid passage 7) by opening the radial grooves 15, are effective in increasing the pump head of the centrifugal pump 1 (Examples 1 and 2).

Comparing Example 1 and Example 2, the centrifugal pump 1 of Example 1 represented relatively higher pump head. It is considered that this results from lower mixing loss in the centrifugal pump 1 of Example 1 in comparison with the centrifugal pump 1' of Example 2.

Figure 10:
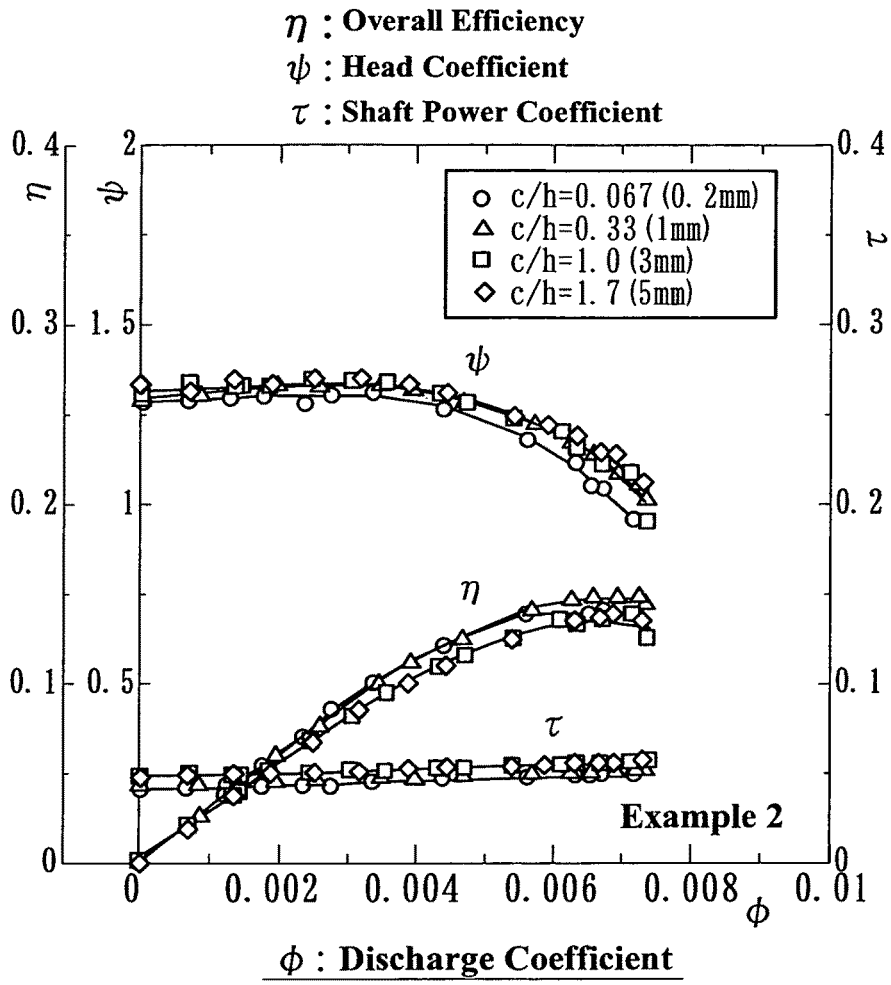
Figure 10:
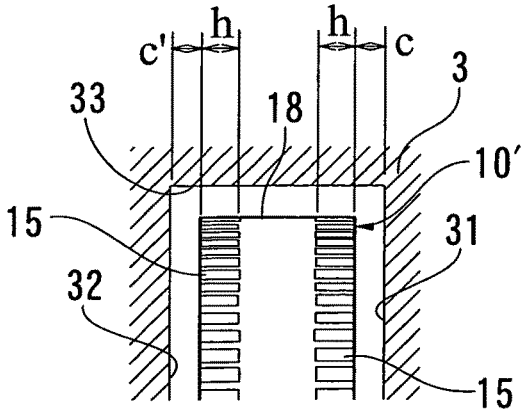

FIG. 10 includes a cross-sectional view and a graph showing influence of the clearance between the impeller 10' and the casing 3.

The inventors conducted an experiment to observe the influence of the clearance between the impeller 10' and the stationary wall surfaces 31, 32 of the casing 3, using the impeller 10' as shown in FIG. 10(B). In this experiment, the distance c' between the impeller 10' and the rear stationary wall surface 32 was fixed at 1.17×h (h=the depth of the grooves 15), and the distance c between the impeller 10' and the front casing wall surface 31 was varied to 0.067×h, 0.33×h, 1.0×h and 1.7×h. The measured results are shown in FIG. 10(A). The numbers in parentheses in FIG. 10(A) are the values of the distance c.

As is apparent from FIG. 10(A), variation in the clearance has almost no effect on the pump performance. This means that the centrifugal pump of the present invention is a novel pump which has properties and characteristics that are entirely different from those of a centrifugal pump provided with an open-type centrifugal impeller or a vortex pump (the pump performance of the centrifugal or vortex pump is significantly affected by varying the clearance).

Figure 11:
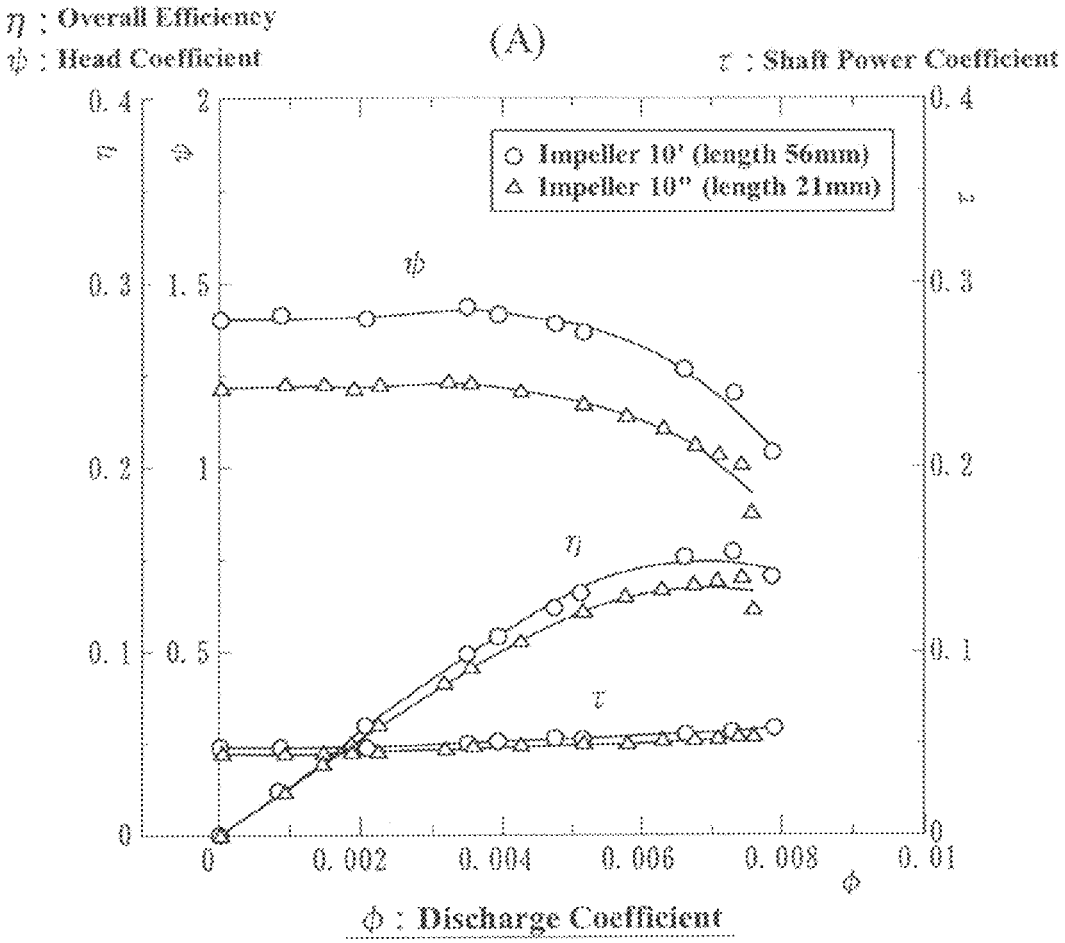
FIGS. 11(A) and 11(B) depict respectively, a perspective view and a graph showing a relationship between a length of the groove and the pump performance.
Figure 11:
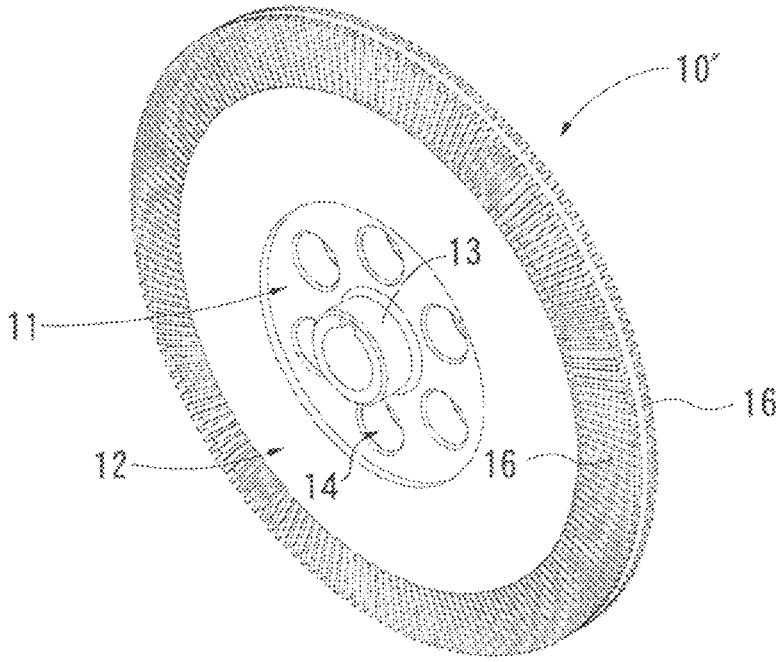

FIG. 11(A) is a graph showing the relationship between the length of the radial grooves 15 and the pump performance, and FIG. 11(B) is a perspective view showing the impeller 10" which is a comparative example.

FIG. 11(B) shows Comparative Example 2 which is an impeller 10" provided with only the outer edge short grooves 16. The impeller 10" has a structure in which all of the radial grooves 15 of the impeller 10' (Example 2) has been replaced with the outer edge short grooves 16. The inventors installed the impeller 10" shown in FIG. 11(B) in a circular casing and measured the pump performance. As a result, it was found that the fluid head is significantly reduced in the impeller 10" provided with only the short grooves 16 (i.e., an impeller 10" which is not provided with the long radial grooves 15), as shown in FIG. 11(A). On the other hand, the fluid head of the impeller 10' is not significantly reduced, even when the short grooves 16 are not provided on the impeller 10'. Therefore, the length of the grooves 15 formed in the impeller is considered to be important in the centrifugal pumps 1, 1' of the present invention.

Figure 12:
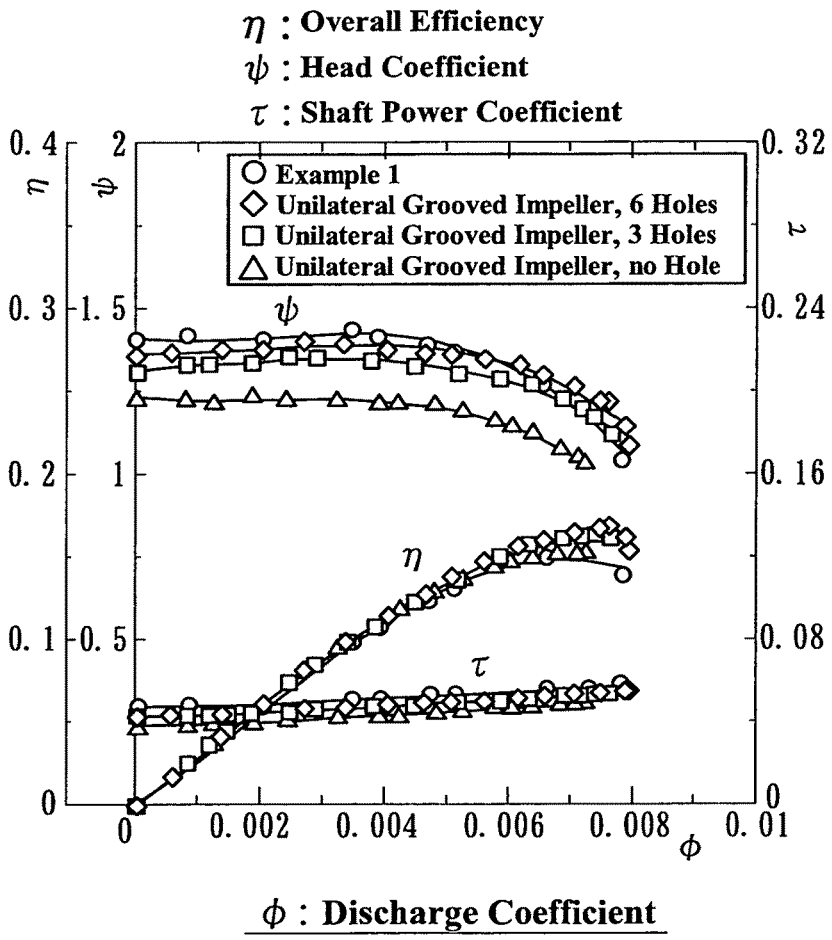
FIG. 12 is a graph showing a relationship between each of two-sided and single-sided arrangements of grooves and the pump performance.
Figure 13:
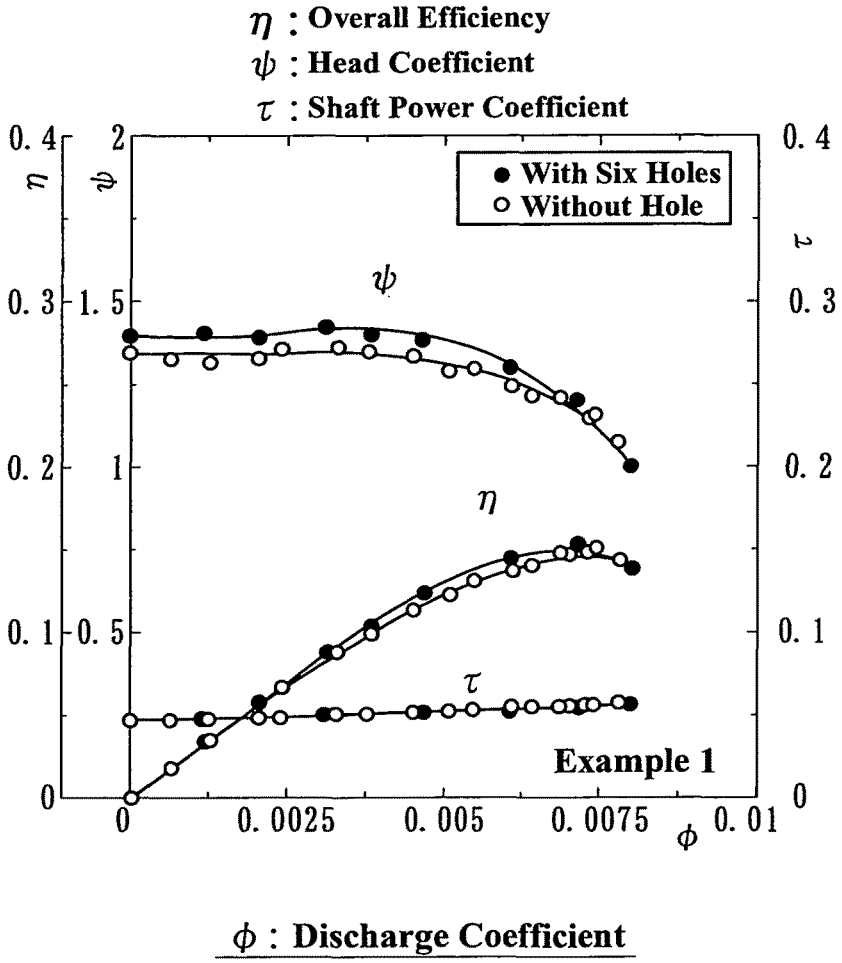
FIG. 13 is a graph showing a relationship between the presence of balance holes and the pump performance.

FIG. 12 is a pump performance graph showing the effect of a bilateral (two-sided) arrangement of the radial grooves 15 and the effect of a unilateral (one-sided) arrangement of the radial grooves 15, and FIG. 13 is a pump performance graph showing the effect of the presence of the balance holes 14.

The inventors operated the centrifugal pump 1 of Example 1 provided with the impeller 10 and measured its performance. The inventors also operated a centrifugal pump provided with an impeller having the radial grooves 15 and the outer edge short grooves 16 on only the front surface of the impeller 10 and measured its performance. In the former impeller (hereinafter referred to as the "bilateral grooved impeller"), the radial grooves 15 and the short grooves 16 were formed on both sides, whereas the latter impeller (hereinafter referred to as the "unilateral grooved impeller") were formed with the radial grooves 15 and the short grooves 16 on only the front face. These impellers were also provided with six balance holes 14, as shown in FIG. 1. The inventors also measured the pump performance of a centrifugal pump having a unilateral grooved impeller with only the three balance holes 14, in which the remaining three balance holes 14 were closed, and a centrifugal pump having a unilateral grooved impeller in which all of the balance holes 14 were closed, that is, a unilateral grooved impeller provided with no balance hole.

As shown in FIG. 12, the unstable head curve characteristics are apt to occur in a low flow rate region in a case where the impeller has the radial grooves 15 provided on only one side. When the number of balance holes 14 is reduced, the fluid head and the shaft power are correspondingly reduced, but the efficiency is substantially unchanged.

FIG. 13 shows the variation in pump performance that occurs if the balance holes 14 are eliminated in the centrifugal pump 1 provided with the impeller 10 of Example 1. The effects of the radial grooves 15 on the rear surface (back surface) can be observed by comparing the measured results shown in FIG. 12 for the unilateral grooved impeller with the measured results shown in FIG. 13 for the bilateral grooved impeller in which all of the balance to holes were eliminated. As is apparent from comparing these measured results, the rear surface radial grooves 15 increase the fluid head and enhance the efficiency of the pump even when all of the balance holes 14 are eliminated.

Figure 14:
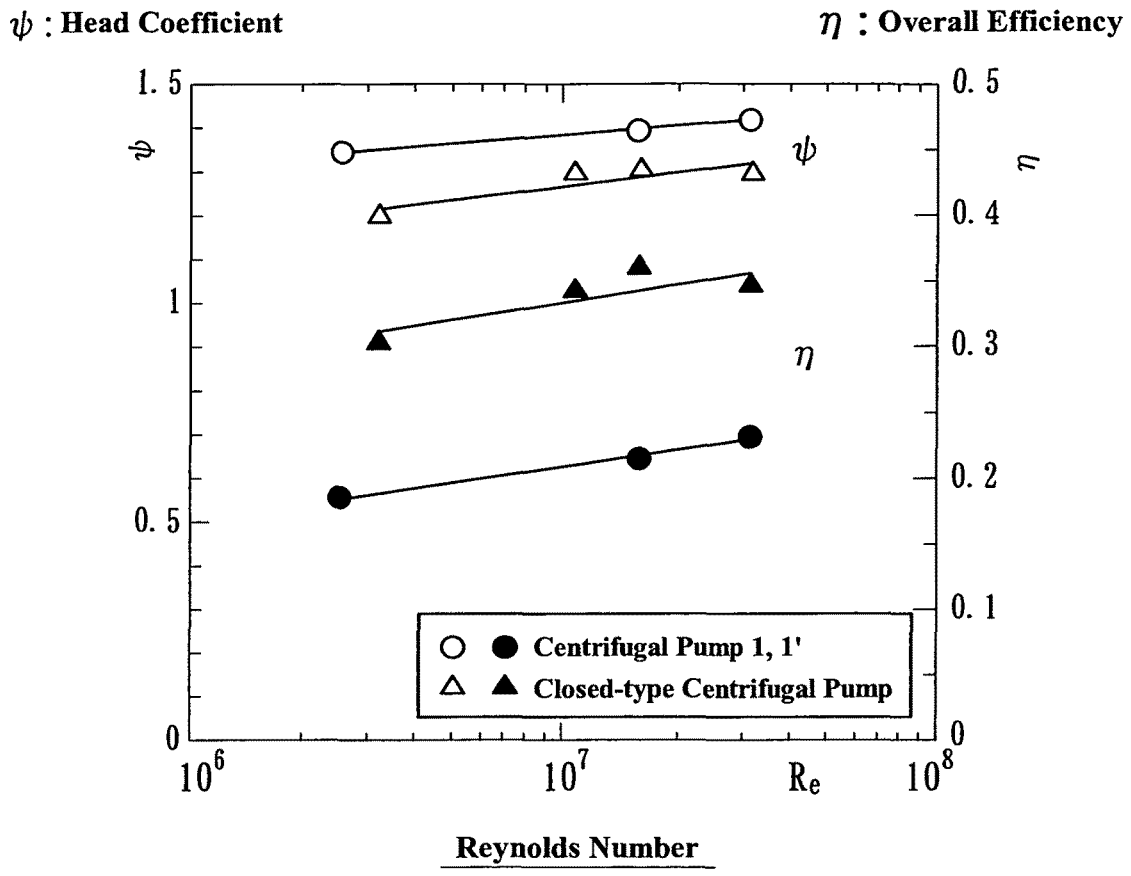
FIG. 14 is a graph showing the relationship between the Reynolds number (Re number) of fluid and the pump performance.

FIG. 14 is a graph showing the relationship among the Reynolds number (Re number) of the fluid as calculated from the peripheral speed of the impeller by CFD, the fluid head of the pump, and the efficiency of the pump.

The centrifugal pumps 1, 1' provided with the impellers 10, 10' have an extremely simple structure, and therefore have advantages in that high speed (rotational speed) can be achieved relatively easily. FIG. 14 shows the variation in the fluid head and the efficiency of a closed-type centrifugal pump and the centrifugal pumps 1, 1' as the Reynolds number increases. As shown in FIG. 14, both of the fluid head and the efficiency are enhanced as the rotation speed is increased (as the Reynolds number is increased), in both of the closed-type centrifugal pump and the centrifugal pumps 1, 1'. The centrifugal pumps 1, 1' are thus considered to be suitable for higher speed.

Figure 15:
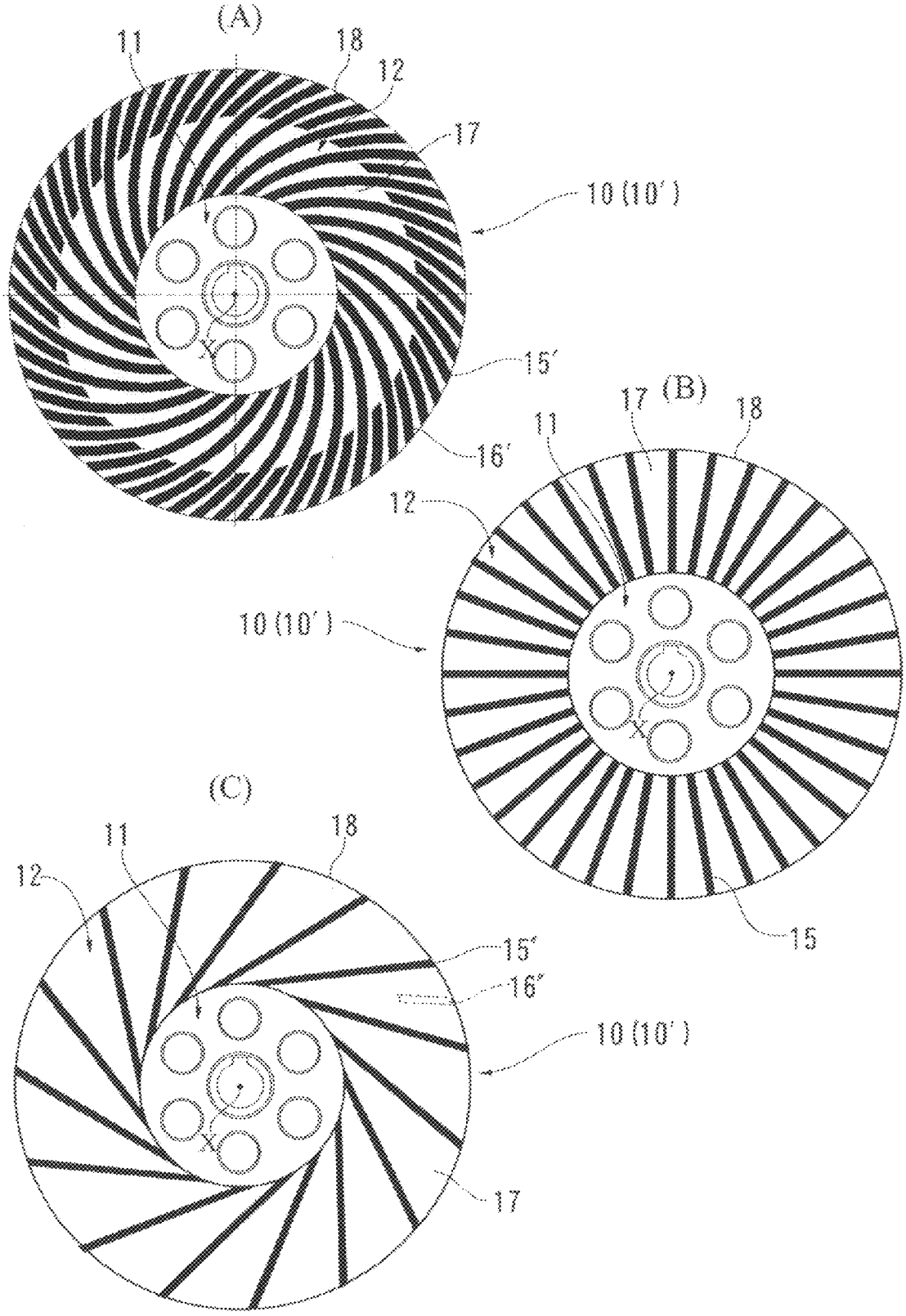

FIG. 15 includes schematic front elevational views showing modifications of the grooves in the impeller.

In the embodiments shown in FIGS. 1 through 7, the impellers 10, 10' are provided with the straight radial grooves 15 and the straight outer edge short grooves 16 which extend radially outward about the rotational axis X-X, but curved grooves (or helical grooves) 15' and curved outer edge short grooves 16' such as those shown in FIG. 15(A) may be formed in the impellers 10, 10'.

Further, the outer edge short grooves 16 as shown in FIGS. 1 through 7 may be omitted, as shown in FIG. 15(B).

Furthermore, straight grooves 15" which extend in a direction tilted at a predetermined angle with respect to the radial direction may be formed in the impellers 10, 10', as shown in FIG. 15(C). Outer edge short grooves 16" may also be formed between the grooves 15", as indicated by the dashed lines in FIG. 15(C).

Preferred embodiments of the present invention are described in detail above. However, the present invention is not limited to these embodiments, but various modifications or changes may be made within the scope of the present invention as described in the claims.

For example, the present invention is applied to a centrifugal pump in the aforementioned embodiments, but the present invention may be applied to a rotary-type (turbo-type) compressor.

Further, the grooves are arranged at an equal angular interval in the aforementioned embodiments, but the grooves may be arranged at irregular intervals.

Furthermore, rectangular cross-sectional grooves having a uniform cross-sectional configuration (shape, width, and depth) over the entire length thereof are described in the aforementioned embodiments, but the cross-sectional configuration (shape, width, and depth) of the grooves may be gradually changed, or the grooves may be designed to have a non-rectangular cross-sectional configuration.

INDUSTRIAL APPLICABILITY

The present invention can be suitably applied to a centrifugal pump, centrifugal compressor, or the other rotary-type fluid machines. According to the present invention, a rotary-type fluid machine can be provided which can be operated practically in an extremely low specific speed range of the high fluid head and the low flow rate, in which a vortex pump or the like had to be used conventionally. In the rotary-type fluid machine, high-speed operation without significant increase in noise can be achieved by increasing the rotational speed. This makes it possible to design a small-sized fluid machine which is capable of practical operation at an extremely low specific speed range.

The fluid machine of the present invention can be applied to an ultra-high pressure or high fluid head conduit system, and can therefore be applied to various conduit systems or systems such as raw material or fuel transport systems in chemical plants, hydraulic circuits of industrial machinery, fluid transport systems of semiconductor manufacturing devices, seawater/feed water conduit systems of seawater desalination plants, or fluid transport systems of $CO_2$ underground storage facilities.

The invention claimed is:

1. A rotary-type fluid machine having an impeller integrally connected to a rotating drive shaft; a casing for accommodating the impeller; and an intake port for fluid to be fed under pressure, which is provided so as to face a radially center portion of the impeller; the fluid machine comprising:

many grooves extending radially outward from the radially center portion of the impeller, which are formed at angular intervals in a side surface of the impeller positioned on its side facing the intake port and opposed against a stationary wall surface of the casing, the angular interval being equal to or less than an angle of 10 degrees, wherein the grooves open toward the stationary wall surface, extend toward an outer circumferential edge of the impeller from a region radially inward of the intake port and open on an outer circumferential surface of the impeller;

wherein a gap between the side surface of the impeller and a side wall surface of the casing has a dimension (q) equal to or greater than 0.4 mm or an impeller diameter $(d_2)\times0.002$; and wherein each of the grooves has a depth (h) equal to or greater than 0.4 mm or the impeller diameter $(d_2)\times0.002$, and the grooves generate radially outward flows of said fluid in the respective grooves and recirculation vortices of the fluid increasing a fluid head of the fluid machine near a peripheral edge of the impeller when the impeller rotates.

2. The machine as defined in claim 1, wherein said groove extends radially outward from the center portion of the impeller in a linear form, or extend outward therefrom in a curved form.

3. The machine as defined in claim 1, wherein said grooves converge in the center portion of the impeller so that an annular or circular depression or concave part is formed in the center portion.

4. The machine as defined in claim 3, wherein a diameter $(d_1)$ of the depression or concave part is larger than a diameter $(d_0)$ of the intake port, and the intake port is entirely encompassed by an external outline of the depression or concave part.

5. The machine as defined in one of claim 1, wherein the dimension (q) of said gap is set to be equal to or greater than 3.0 mm, or equal to or greater than the impeller diameter $(d_2)\times0.015$.

6. The machine as defined in claim 1, wherein many grooves extending radially outward from the radially center portion of the impeller are further formed in a side surface of the impeller opposite to its side facing the intake port.

7. The machine as defined in claim 6, wherein communicating means for causing the gaps on both sides of the impeller to be in fluid communication with each other is provided in the radially center portion of the impeller.

8. The machine as defined in claim 1, wherein a depth (h) of the groove is set to be equal to or less than 6.0 mm or the impeller diameter $(d_2)\times0.03$, and a width (w) of the groove is set to be equal to or less than 40 mm or the impeller diameter $(d_2)\times0.20$.

9. The machine as defined in claim 1, wherein a thickness (T) of the center portion of the impeller is set to be a dimension larger than a thickness (T') of a peripheral portion of the impeller.

10. The machine as defined in claim 1, wherein the casing is a circular casing, which has a front side wall surface, a rear side wall surface and an annular inner circumferential wall surface, and which defines a circular casing inside region centering around a rotational axis of the impeller;

a fluid suction passage for a fluid to be pumped is connected with the intake port of the fluid; and a fluid delivery passage for discharging the fluid from the casing to its outside under pressure of a fluid passage in the casing is connected to said annular inner circumferential wall surface.

11. The machine as defined in claim 1, wherein the recirculation vortices (R) are formed by radially outward flows (F) formed inside the grooves, radially inward flows (E) formed near the side wall surface of the casing, and recirculation flows (G) splitting from the radially inward flows (E) and recirculating into the grooves.

12. The machine as defined in claim 11, wherein the radially outward flows (F) turn radially inward between an outer circumferential edge of the impeller and an annular inner circumferential wall surface (33) of the casing, and flow backward in the vicinity of the stationary wall surface as the radially inward flows (C, E).

13. The fluid machine as defined in claim 1, wherein said grooves are arranged uniformly at regular intervals (k) in the entire side surface of the impeller.

14. The fluid machine as defined in claim 1, wherein the fluid machine is a centrifugal pump which operates in an extremely low specific speed range equal to or less than 70.

15. A rotary-type fluid machine having an impeller integrally connected to a rotating drive shaft; a casing for accommodating the impeller; and an intake port for fluid to be fed under pressure, which is provided so as to face a radially center portion of the impeller; the fluid machine comprising:

many grooves for generating recirculation vortices of said fluid increasing a fluid head of the fluid machine near an outer edge of the impeller during rotation of the impeller, which are formed in both side surfaces of the impeller opposing against stationary wall surfaces of the casing, wherein the grooves in each of the surfaces of the impeller open toward stationary toward the stationary wall surface, extend at angular intervals toward an outer circumferential edge of the impeller from a region radially inward of the intake port and open on an outer circumferential surface of the impeller, the angular interval being equal to or less than an angle of 10 degrees, whereby radially outward flows of said fluid are generated in the respective grooves when the impeller rotates.

16. The machine as defined in claim 15, wherein fluid communication holes extend through the radially center portion of the impeller, and each of the holes causes gaps on both sides of the impeller to be in fluid communication with each other, each of the gaps being formed between each of the surfaces of the impeller and each of side wall surfaces of the casing.

17. The machine as defined in claim 15, wherein said grooves converge in the radially center portion of the impeller so that an annular or circular depression or concave part is formed in the center portion, and said holes are located in the depression or concave part.

18. The machine as defined in claim 15, wherein the casing is a circular casing, which has a front side wall surface, a rear side wall surface and an annular inner circumferential wall surface, and which defines a circular casing inside region centering around a rotational axis of the impeller;

a fluid suction passage for a fluid to be pumped is connected with the intake port; and a fluid delivery passage for discharging the fluid from the casing to its outside under pressure of a fluid passage in the casing is connected to said annular inner circumferential wall surface.

19. A rotary-type fluid machine having an impeller integrally connected to a rotating drive shaft; a casing for accommodating the impeller; and an intake port for fluid to be fed under pressure, which is provided so as to face a radially center portion of the impeller; the fluid machine comprising:

many grooves for generating recirculation vortices of said fluid near an outer edge of the impeller during rotation of the impeller, which grooves are formed in a side surface of the impeller positioned on its side facing the intake port and opposing against a stationary wall surface of the casing so that the vortices increase a fluid head of the fluid machine by raising a fluid pressure throughout a circumferential annular fluid passage outside of said impeller wherein the grooves open toward the stationary wall surface, extend at angular intervals toward an outer circumferential edge of the impeller from a region radially inward of the intake port and opening on an outer circumferential surface of the impeller;

wherein the grooves have a depth (h) equal to or less than 0.6 mm or the impeller diameter $(d_2)\times0.03$;

wherein the casing is a circular casing, which has a front side wall surface, a rear side wall surface and an annular inner circumferential wall surface, and which defines a circular casing inside region centering around a rotational axis of the impeller; and wherein the recirculation vortices (R) are formed by radially outward flows (F) generated inside the grooves, radially inward flows (E) generated near the side wall surface of the casing, and recirculation flows (G) splitting from the radially inward flows (E) and recirculating into the grooves.

20. The machine as defined in claim 19, wherein the radially outward flows (F) turn radially inward between the outer circumferential edge of the impeller and the annular inner circumferential wall surface (33) of the casing, and flow backward in the vicinity of said side wall surface of the casing as the radially inward flows (C, E).

* * * * *

UNITED STATES PATENT AND TRADEMARK OFFICE

CERTIFICATE OF CORRECTION

PATENT NO. : 8,469,654 B2
APPLICATION NO. : 12/735600
DATED : June 25, 2013
INVENTOR(S) : Junichi Kurokawa et al.

It is certified that error appears in the above-identified patent and that said Letters Patent is hereby corrected as shown below:

In the Specification

Column 1, Line 6, Delete “2010” and insert -- 2009 --, therefor.

Column 1, Line 7, Delete “2010” and insert -- 2008 --, therefor.

Signed and Sealed this
Fifteenth Day of October, 2013

Teresa Stanek Rea
*Deputy Director of the United States Patent and Trademark Office*